US008342498B2

(12) United States Patent
Urano

(10) Patent No.: US 8,342,498 B2
(45) Date of Patent: Jan. 1, 2013

(54) SHEET POST-PROCESSING APPARATUS AND IMAGE FORMING APPARATUS

(75) Inventor: Yuri Urano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 13/009,089

(22) Filed: Jan. 19, 2011

(65) Prior Publication Data

US 2011/0176892 A1 Jul. 21, 2011

(30) Foreign Application Priority Data

Jan. 20, 2010 (JP) ..... 2010-009839

(51) Int. Cl.
*B31F 1/10* (2006.01)

(52) U.S. Cl. ..... 270/45; 270/32; 270/58.07

(58) Field of Classification Search ..... 270/32, 270/45, 51, 58.07; 493/406, 407, 442, 454
See application file for complete search history.

(56) References Cited

U.S. PATENT DOCUMENTS

| | | | | |
|---|---|---|---|---|
| 6,692,208 | B1 | 2/2004 | Watkiss et al. | |
| 6,905,118 | B2 * | 6/2005 | Yamada et al. | 270/8 |
| 7,594,645 | B2 * | 9/2009 | Suzuki et al. | 270/37 |
| 2007/0060459 | A1 | 3/2007 | Hayashi | |
| 2010/0230886 | A1 | 9/2010 | Watanabe et al. | |

OTHER PUBLICATIONS

European Search Report dated May 25, 2011, in counterpart European Patent Application No. 11151403.
Office Action dated Oct. 23, 2012, in counterpart Chinese Patent Application No. 201110008547.2.

* cited by examiner

*Primary Examiner* — Leslie A Nicholson, III
(74) *Attorney, Agent, or Firm* — Fitzpatrick, Cella, Harper & Scinto

(57) ABSTRACT

A sheet post-processing apparatus is capable of neatly squaring a booklet spine without any damage such as a wrinkle on the spine, usable in an image forming apparatus. According to the sheet post-processing apparatus, a drive motor drives first and second pressing members. A circumferential velocity of the pressing member on a pressing surface pressed against the booklet spine is configured to be reverse to and greater than a moving velocity of a moving portion.

12 Claims, 18 Drawing Sheets

SHEET POST-PROCESSING APPARATUS AND IMAGE FORMING APPARATUS

BACKGROUND OF THE INVENTION

1. Field of the Invention

The present invention relates to a sheet post-processing apparatus to apply post-processing to a spine of a folded sheet bundle and an image forming apparatus having the sheet post-processing apparatus. More specifically, the present invention relates to a sheet post-processing apparatus which cosmeticizes a booklet by squaring a spine of a saddle-stitch booklet.

2. Description of the Related Art

Conventionally, when a sheet bundle including about 20 or more sheets as a set is folded at a time, a booklet is formed having a vicinity of a spine being curved obviously. Such a booklet, when folded, easily opens at the side opposite the spine, giving an awkward appearance. Since the booklet cannot be placed flat, it has been difficult to stack many booklets.

To solve this problem, U.S. Pat. No. 6,692,208 proposes a technology of pressing a swelled spine of the booklet and squaring a spine 2*a*1. The technology of U.S. Pat. No. 6,692,208 will be described with reference to FIGS. 17 and 18. As illustrated in FIG. 17A, conveying units 706 and 707 convey a booklet 2*a* with its spine 2*a*1 set to the leading position. The spine 2*a*1 of the booklet 2*a* stops against a positioning unit 705 for positioning. Holding portions 702 and 703 nip the booklet 2*a*. The positioning unit 705 retracts. A pressing roller 704 rotates and moves along the spine 2*a*1 in a direction A in FIG. 17B while applying a pressure to the spine 2*a*1 of the booklet 2*a*. In this manner, the squaring process is applied to the swelled spine 2*a*1. FIG. 17B is a schematic diagram illustrating the moving direction of the pressing roller 704. The pressing roller 704 retracts to an area free of contact with the booklet 2*a* until the holding portions 702 and 703 nip the booklet 2*a*. When the grip portions 702 and 703 nip and hold the booklet 2*a*, the pressing roller 704 moves from one end to the other end of the booklet 2*a* as applying pressure to the spine 2*a*1.

According to the technology described in U.S. Pat. No. 6,692,208, the pressing roller 704 rolls on and presses to deform the spine 2*a*1 of the booklet 2*a* held by the holding portions 702 and 703. In FIG. 18, a circumferential velocity V is measured on a pressing surface where the pressing roller 704 is pressed against the spine 2*a*1 of the booklet 2*a*. The pressing roller 704 moves along the spine 2*a*1 at a moving velocity W. In this case, the circumferential velocity V equals the moving velocity W. The pressing roller 704 pushes the spine 2*a*1 downstream in the moving direction (direction of W in FIG. 18) on the pressing surface between the pressing roller 704 and the spine 2*a*1 of the booklet 2*a*. Pressing by the pressing roller 704 deforms and squares the spine 2*a*1 of the booklet 2*a* along which the pressing roller 704 has passed. When the pressing roller 704 presses the spine 2*a*1, the pressing surface of the spine 2*a*1 of the booklet 2*a* is pushed in the moving direction (direction of W) of the pressing roller 704 at a supporting point where the holding portions 702 and 703 hold the booklet 2*a*. As illustrated in FIG. 18, an oblique wrinkle C is generated between the supporting point of the spine 2*a*1 of the booklet 2*a* held by the holding portions 702 and 703 and the pressing surface pushed downstream by the pressing roller 704, which causes disfigurement. The wrinkle C is remarkable when the booklet 2*a* is made of thin paper. When a letter or a picture is printed on the surface near the spine 2*a*1 of the booklet 2*a*, an occurrence of the wrinkle C removes the toner applied to the surface of the booklet 2*a*. The booklet 2*a* is further disfigured.

The present invention neatly squares a booklet spine without any damage such as a wrinkle on the spine.

SUMMARY OF THE INVENTION

A sheet post-processing apparatus according to the invention is typically configured to include: a holding portion which holds a folded booklet; a pressing member configured to have a pressing surface which rotates and presses a spine of the booklet held by the holding portion; a driving portion which drives the pressing member; a moving portion which holds the pressing member and moves along the booklet spine; and a controlling portion which controls the driving portion so that a circumferential velocity of the pressing surface at a position where the pressing surface presses against the booklet spine is in a reverse direction to a moving velocity of the moving portion, and is greater than the moving velocity.

According to the invention, the pressing member moves at a circumferential velocity greater than a moving velocity of the moving portion on the pressing surface pressed against the booklet spine. Therefore, the pressing member does not squeeze the booklet spine downstream in the moving direction of the pressing member on the pressing surface between the booklet spine and the pressing member. The squaring process can be performed while pressing and smoothing a deformed part of the booklet spine upstream in the moving direction of the pressing member. For this reason, the booklet spine does not wrinkle. The booklet quality can be therefore improved.

Further features of the present invention will become apparent from the following description of exemplary embodiments with reference to the attached drawings.

DESCRIPTION OF THE EMBODIMENTS

First Embodiment

Figure 1:
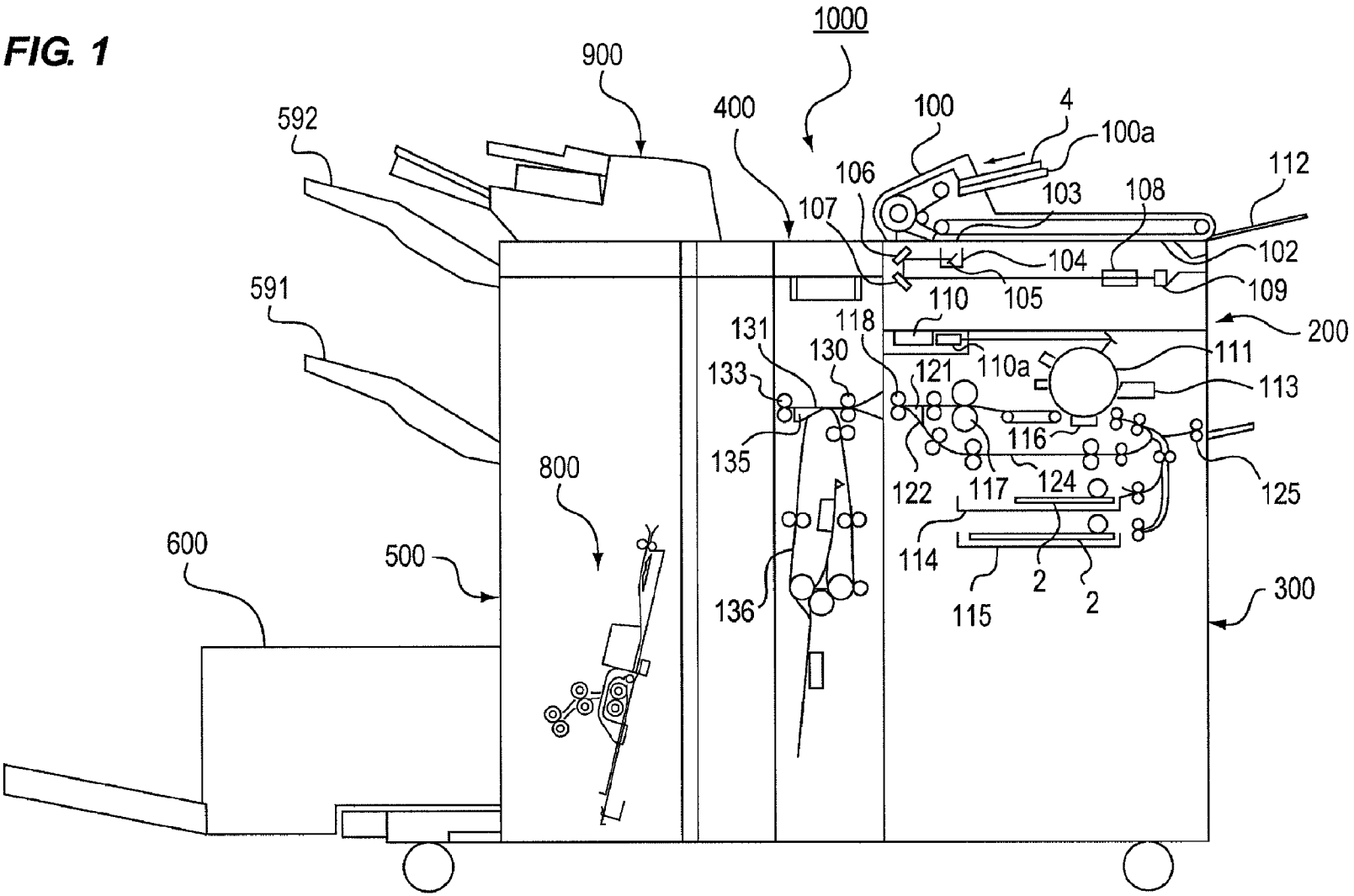
FIG. 1 is an explanatory sectional view illustrating a configuration of a copier having a sheet post-processing apparatus according to the invention.
Figure 2:
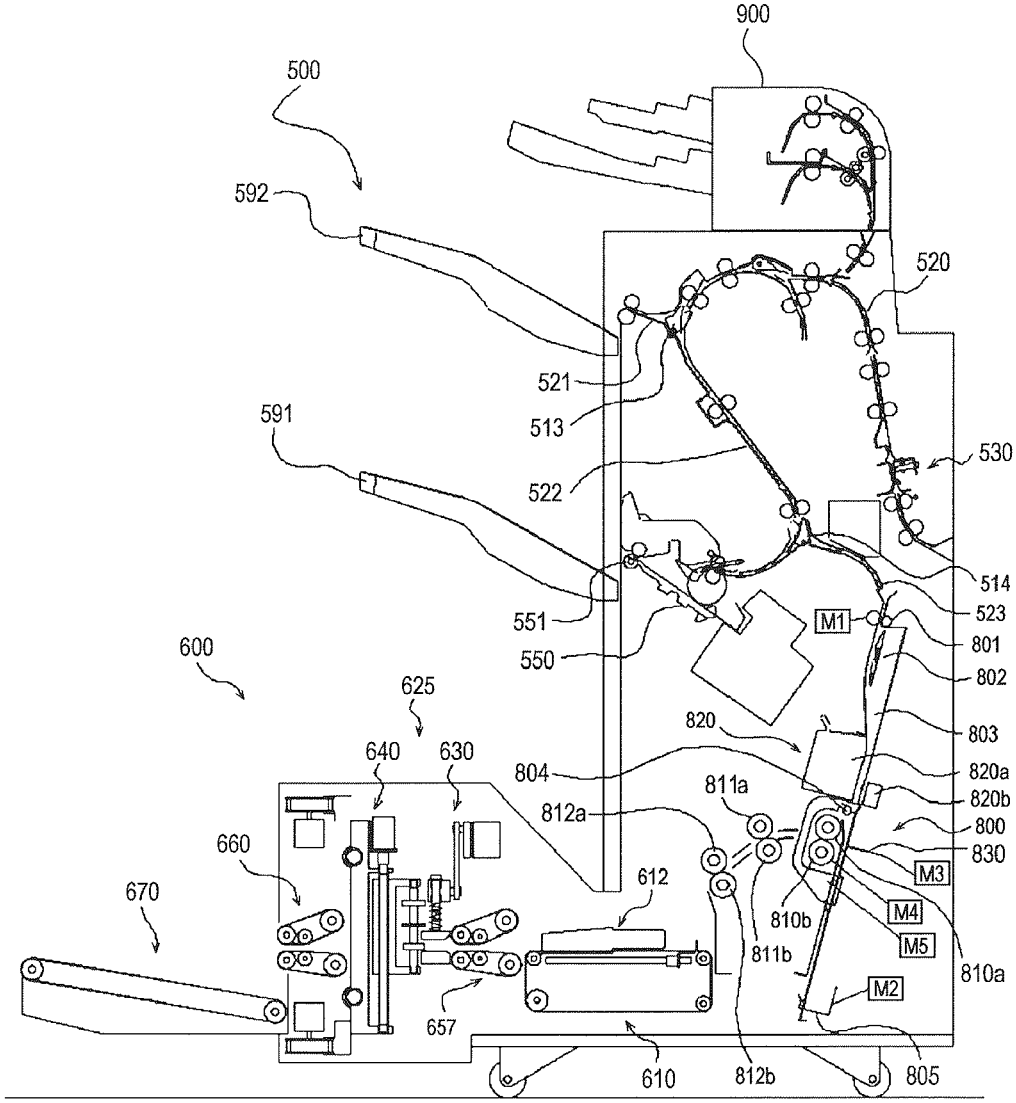
FIG. 2 is an explanatory sectional view illustrating a configuration of a bookbinding apparatus having the sheet post-processing apparatus according to the invention.

In the following, exemplary embodiments of the present invention will be described in detail with reference to the drawings. FIG. 2 illustrates essential parts of the sheet post-processing apparatus according to the invention. FIG. 1 is a sectional view illustrating an internal structure of a copier 1000 as an image forming apparatus capable of using the sheet post-processing apparatus according to the invention. The copier 1000 includes a document feed portion 100, an image reader portion 200, a printer portion 300, a fold processing portion 400, a finisher 500, a saddle stitch binding portion 800 (shown in FIG. 2), a squaring processing portion 600, and an inserter 900. The fold processing portion 400, the saddle stitch binding portion 800, the squaring processing portion 600, and the inserter 900 are optional.

As illustrated in FIG. 1, a document 4 is placed in a document tray 100*a* of a document feed portion 100. The document feed portion 100 conveys the document 4 one sheet at a time from the start page to the left of FIG. 1 (direction of an arrow in FIG. 1). The document 4 is further conveyed on a platen glass 102 through a curved conveying path from the left to the right in FIG. 1 and then is discharged onto a discharge tray 112. At that time, a scanner unit 104 is stationed at a predetermined position. The document 4 is scanned when it passes over the scanner unit 104 from the left to the right in FIG. 1. When the document 4 passes on the platen glass 102, the document 4 is irradiated with light from a lamp 103 of the scanner unit 104. Reflected light from the document 4 passes through mirrors 105, 106, and 107, and a lens 108, and is guided to an image sensor 109.

The image sensor 109 reads image data from the document 4. The read image data is processed as specified and is sent to an exposure controlling portion 110. The exposure controlling portion 110 outputs a laser beam according to an image signal. The laser beam is scanned by a polygon mirror 110*a* and is irradiated onto a photosensitive drum 111. An electrostatic latent image corresponding to the scanned laser beam is formed on the photosensitive drum 111.

A development device 113 develops the electrostatic latent image formed on the photosensitive drum 111. The developed electrostatic latent image is made visible as a toner image. On the other hand, a recording sheet (hereafter simply referred to as a "sheet") 2 is conveyed to a transfer portion 116 from any of sheet cassettes 114 and 115, a manual feed portion 125, and a duplex conveying path 124. The transfer portion 116, the photosensitive drum 111, and the development device 113 constitute an image forming portion. The transfer portion 116 transfers the visualized toner image to the sheet 2. A fixing portion 117 performs a fixing process on the transferred sheet 2.

The sheet 2 passing through the fixing portion 117 is temporarily guided to a conveying path 122 by a changeover member 121. After the trailing end of the sheet 2 completely passes through the changeover flapper 121, the sheet 2 is switched back to be conveyed to a discharge roller 118 by the changeover flapper 121. The discharge roller 118 discharges the sheet 2 from the printer portion 300. Thus, the sheet 2 is discharged from the printer portion 300 in a state that the surface having the toner image formed thereon faces downward (face-down). This discharge mode is called reverse discharge.

The sheet 2 is discharged from the apparatus with the face-down state as described above. Accordingly, the order of pages can be registered when an image forming process is performed one by one from a head page using the document feed portion 100 or is performed on image data from a computer, for example.

The configuration of the finisher 500 will next be described with reference to FIGS. 1 and 2. The fold processing portion 400 includes a conveying path 131 which receives the sheet 2 discharged from the printer portion 300 and guides it to the finisher 500. Conveying roller pairs 130 and 133 are provided on the conveying path 131. A changeover flapper 135 is provided near the pair of conveying rollers 133 and guides the sheet 2 conveyed by the pair of conveying rollers 130 to a folding path 136 or the finisher 500.

The finisher 500 takes in the sheet 2 conveyed from the printer portion 300 via the fold processing portion 400. The finisher 500 performs processes for the sheet 2 such as a process of aligning and binding up plural sheets 2 being taken in as one bundle of the sheets 2, a stapling process (binding process) of stapling a trailing end of the bundle of the sheets 2, a sorting process, and a non-sorting process. The fold processing portion 400 folds a stack of plural sheets 2 double.

As illustrated in FIG. 2, the finisher 500 has a conveying path 520 that takes the sheet 2 conveyed through the fold processing portion 400 into the apparatus. The conveying path 520 is provided with plural pairs of conveying rollers. A punch unit 530 is provided at a midpoint of the conveying path 520 and is operated as needed to perform a punching process to the trailing end of the conveyed sheet 2.

A changeover flapper 513 is provided at the end of the conveying path 520 and switches the conveying path to an upper discharge path 521 and a lower discharge path 522 connected downstream. The upper discharge path 521 discharges a sheet to an upper stack tray 592. The lower discharge path 522 discharges a sheet to a process tray 550. The sheet 2 discharged to the process tray 550 is sequentially aligned and bundled. The sheet 2 is sorted or stapled based on settings of an operation portion 1 illustrated in FIG. 10. A pair of bundle discharge rollers 551 then discharges the sheet 2 to a lower stack tray 591.

Next, a configuration of the saddle stitch binding portion 800 will be described. A changeover flapper 514 is provided at a midpoint of the lower discharge path 522 and changes the sheet 2 to the right of FIG. 2. With the changeover flapper 514, the sheet 2 then passes through a saddle discharge path 523 and is conveyed to the saddle stitch binding portion 800. A pair of saddle inlet rollers 801 accepts the sheet 2. A flapper 802 is operated by a solenoid according to a sheet size and selects a carry-in port. The sheet 2 is then carried in an accommodating guide 803 in the saddle stitch binding portion 800. A slide roller 804 conveys the sheet 2 until the leading end thereof is brought into contact with a movable sheet positioning member 805. A drive motor M1 drives the pair of saddle inlet rollers 801 and the slide roller 804.

A stapler 820 is provided at the middle portion of the accommodating guide 803 to be opposed to the accommodating guide 803 and sandwich a sheet therebetween. The stapler 820 is divided into a driver 820*a* that projects staples and an anvil 820*b* that bends the projected staples. The sheet positioning member 805 stops at the portion where the central portion of the sheet in the sheet conveying direction is located at the binding position of the stapler 820, when the sheet 2 is carried in. The sheet positioning member 805 is movable through the drive of a motor M2, and changes its position according to a sheet size.

Figure 3:
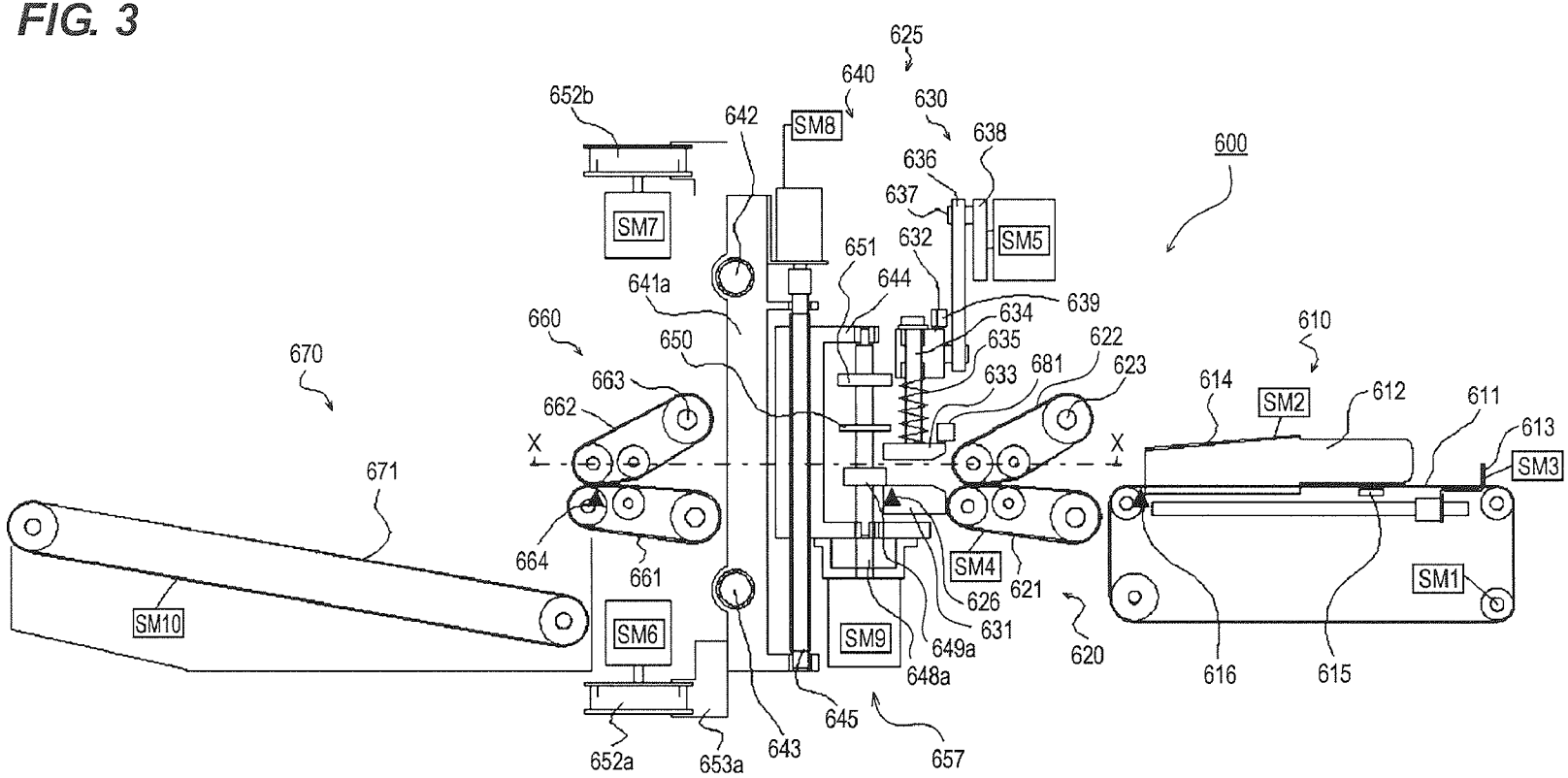
FIG. 3 is an explanatory sectional view illustrating a configuration of the sheet post-processing apparatus according to the invention.

A pair of folding rollers 810*a* and 810*b* is provided at the downstream side of the stapler 820. A projecting member 830 is provided at the position opposite to the pair of folding rollers 810*a* and 810*b*. The position where the projecting member 830 retracts from the accommodating guide 803 is specified as a home position. The projecting member 830, driven by a motor M3, projects toward the accommodated bundle of sheets 2 and folds it while pressing it into a nip between the pair of folding rollers 810*a* and 810*b*. Thereafter, the projecting member 830 returns again to the home position. A spring (not illustrated) applies pressure F1 sufficient for folding the bundle of sheets 2 between the pair of folding rollers 810*a* and 810*b*. The folded bundle of sheets 2 passes through a pair of first fold and conveying rollers 811*a* and 811*b* and a pair of second fold and conveying rollers 812*a* and 812*b*, and is discharged onto a lower conveying belt 611 of a booklet receiving portion 610 as illustrated in FIG. 3.

Next, the squaring processing portion 600 will be described. The squaring processing portion 600 is located downstream of the saddle stitch binding portion 800 in the booklet conveying direction (left in FIG. 2). FIG. 3 is an enlarged view of the squaring processing portion 600 in FIG. 2. There is provided, upon the booklet receiving portion 610 in FIG. 3, a lower conveying belt 611. The lower conveying belt 611 receives the booklet 2*a*, the bound bundle of sheets 2, from the saddle stitch binding portion 800 and conveys it. When the booklet 2*a* is received, the lower conveying belt 611 rotates in the conveying direction. Therefore, even if the booklet 2*a* drops from the pair of second fold conveying rollers 812*a* and 812*b*, the lower conveying belt 611 can receive the booklet with the posture kept as it is conveyed without allowing the booklet 2*a* to rotate.

A pair of side guides 612 is arranged at the outside of the lower conveying belt 611 across the lower conveying belt 611. The pair of side guides 612 operates in the width direction of the booklet 2*a*, thereby being capable of correcting the position of the booklet 2*a* in the width direction. A pressing guide 614 for preventing the booklet 2*a* being opened is formed at the upper part of the pair of side guides 612. The pressing guide 614 functions as a guide for smoothly feeding the booklet 2*a* to the downstream side in the booklet conveying direction. A transport claw 613 that moves in parallel to the lower conveying belt 611 is arranged at both sides of the lower conveying belt 611. The transport claw 613 moves in the forward and reverse directions at the velocity approximately equal to the velocity of the lower conveying belt 611. When a slippage is produced between the lower conveying belt 611 and the booklet 2*a*, the transport claw 613 is brought into contact with the trailing end of the booklet 2*a* to surely push the trailing end of the booklet 2*a* toward the downstream side in the booklet conveying direction. The lower conveying belt 611, the pair of side guides 612, and the transport claw 613 respectively operate through drives of the motors SM1, SM2, and SM3.

An inlet conveying portion 620 includes a lower conveying belt 621 and an upper conveying belt 622 that receive the booklet 2*a* from the booklet receiving portion 610 and convey it downstream in the booklet conveying direction. The upper conveying belt 622 can move about a supporting point 623 in contact with the top face of the booklet 2*a* according to a thickness of the booklet 2*a*. The upper conveying belt 622 is pressed against the lower conveying belt 621 by a spring (not illustrated). The lower and upper conveying belts 621 and 622 are driven by a drive motor SM4. A booklet inlet detection sensor 615 detects that the booklet 2*a* is received from the saddle stitch binding portion 800, and that the booklet 2*a* is on the lower conveying belt 611. A booklet outlet detection sensor 616 detects the booklet 2*a* to output an input signal for operating the pair of side guides 612 and the transport claw 613.

A squaring processing portion 625 includes a pressing unit 630 and a squaring unit 640. The pressing unit 630 vertically presses a vicinity of the spine 2*a*1 of the booklet 2*a*. The squaring unit 640 positions and presses the spine 2*a*1 of the booklet 2*a*.

The pressing unit 630 is structured by an upper pressing plate 633 and a lower pressing plate 631 being isolated from each other. The upper pressing plate 633 moves vertically. The lower pressing plate 631 is fixed to a frame opposite the upper pressing plate 633. The upper pressing plate 633 and the lower pressing plate 631 form, in combination, a holding portion that holds the folded booklet 2*a*. An upper part of the pressing unit 630 includes a strong pressing base 632 and an upper pressing plate 633. The pressing base 632 is driven by a drive motor SM5 and vertically moves through links 636, 637, and 638. The upper pressing plate 633 is coupled with a slide coupling member 634. A compression spring 635 is arranged at the outer periphery of the slide coupling member 634. When the pressing base 632 is at the upper position, the upper and lower pressing plates 631 and 633 are separated apart from each other. The booklet 2*a* is conveyed between the upper and lower pressing plates 631 and 633.

When the pressing base 632 is at the lower position, the booklet 2*a* is firmly nipped and held by the upper and lower pressing plates 631 and 633 by the compression spring 635 that is expanded and compressed according to the thickness of the booklet 2*a*. Since the contact surfaces to the booklet 2*a* of the upper and lower pressing plates 631 and 633 are squaring surfaces having no projection, a pressing mark cannot be formed on the booklet 2*a* when the booklet 2*a* is nipped and held therebetween. A top dead center detection sensor 639 detects that the pressing base 632 is at the upper position. A thickness detection sensor 681 detects the thickness of the booklet 2*a* by detecting the position of the upper pressing plate 633 when the booklet 2*a* is fixed.

Figure 4:
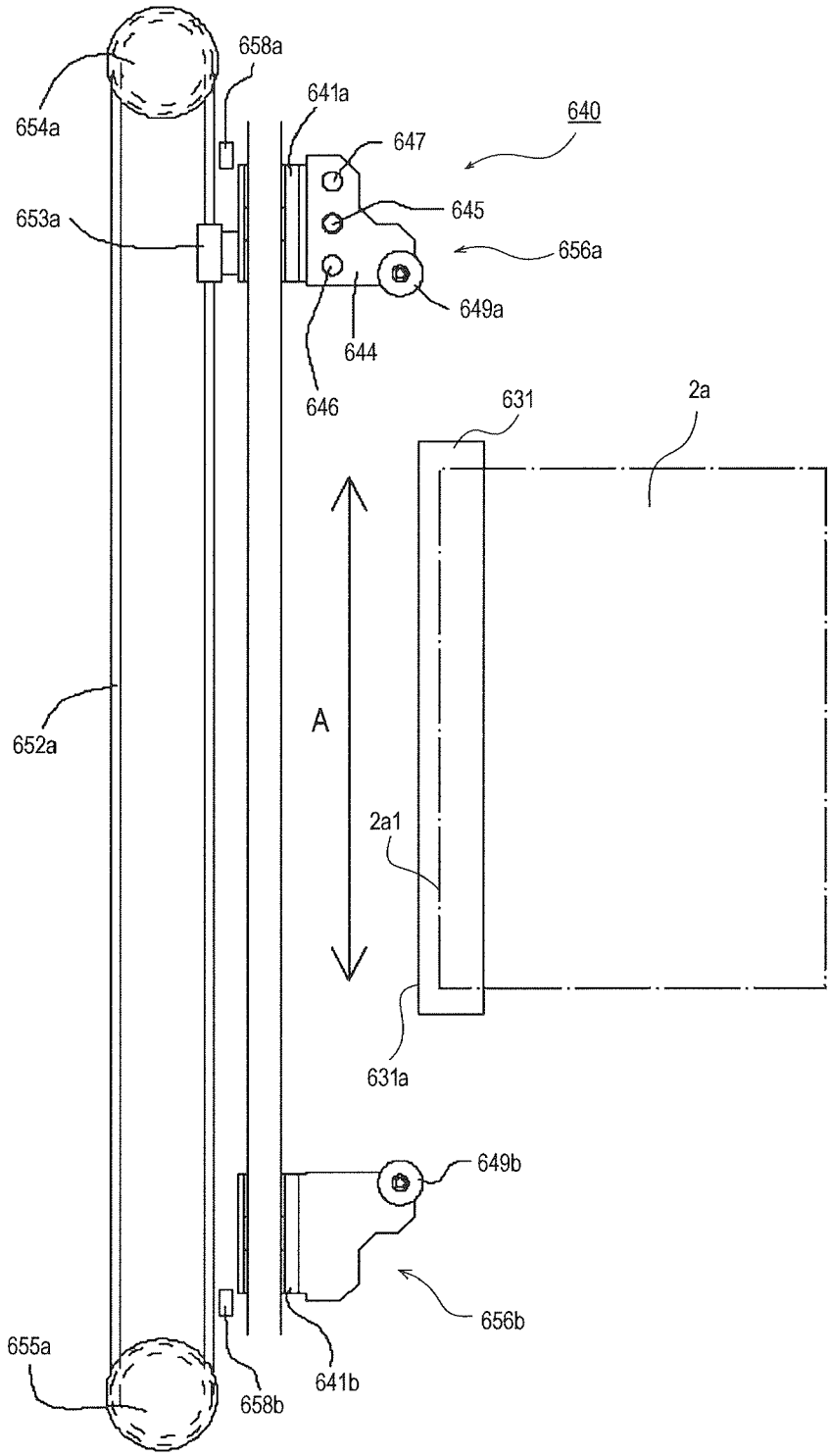
FIG. 4 is an explanatory plan view illustrating a configuration of a squaring unit.
Figure 5:
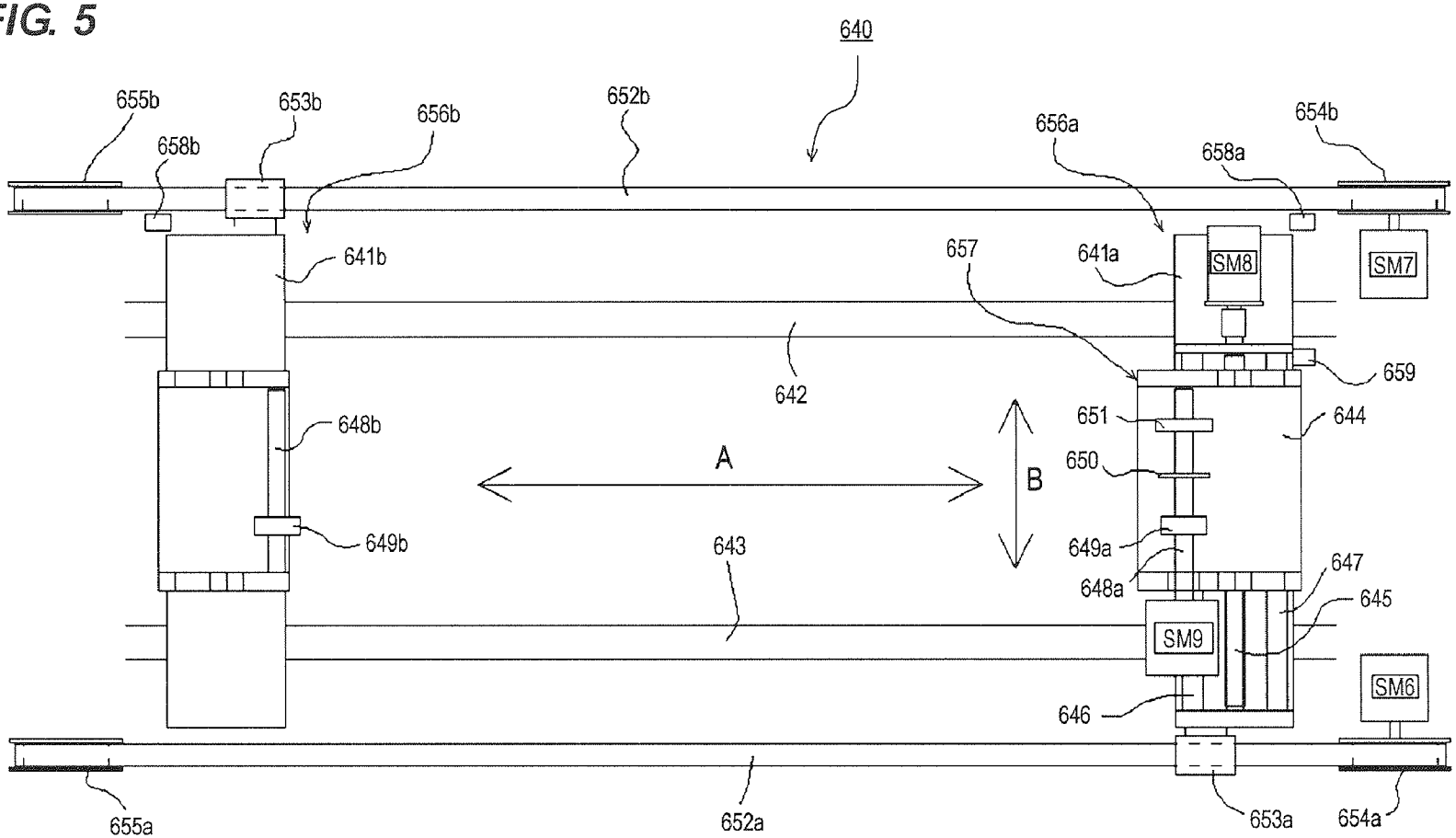
FIG. 5 is an explanatory side view illustrating a configuration of the squaring unit.

Next, the squaring unit 640 will be described with reference to FIGS. 3 through 5. FIG. 4 is an oblique view of FIG. 3 taken along a line X-X. FIG. 5 is a view when the squaring unit 640 in FIG. 3 is seen from the right side. The squaring unit 640 is provided with a moving unit 656*a*. The moving unit 656*a* is movable along slide shafts 642 and 643 supported by a frame (not illustrated) and is supported so as to be movable in the direction of an arrow A as illustrated in FIGS. 4 and 5. The moving unit 656*a* is mounted onto a timing belt 652*a* by a coupling member 653*a*, and driven by a drive motor SM6 through pulleys 654*a* and 655*a*.

The moving unit 656*a* illustrated in FIG. 5 has a moving base 641*a*. Slide shafts 646 and 647 are fixed to the moving base 641*a* and slidably support a changeover unit 657 that changes the pressing member. The changeover unit 657 can move in a direction of B in FIG. 5 along the slide shafts 646 and 647 by a slide screw 645 and a drive motor SM8.

In the changeover unit 657, a support shaft 648*a* is mounted to a changeover base 644 so as to be rotatable. A stopper member 649*a* is fixed to the support shaft 648*a*. A first pressing member 650 and a second pressing member 651 are also fixed to the support shaft 648*a*. These pressing members include rollers which function as a pressing member rotating to press the spine 2*a*1 of the booklet 2*a* that is nipped, and held by the lower pressing plate 631 and the upper pressing plate 633 which function as a holding portion in combination. According to the embodiment, the disk-shaped roller presses the spine 2*a*1 of the booklet 2*a* and is capable of gradually applying a uniform pressing force to the spine 2*a*1. Therefore, the spine 2*a*1 of the booklet 2*a* can be smoothly squared. Unlike examples of the related art, the squaring process according to the embodiment squares a booklet spine while suppressing deformation in the booklet thickness direction.

The stopper member 649*a* cooperates with a later-described stopper member 649*b* to put the booklet 2*a* into a position for the squaring process by contact with the spine 2*a*1 of the conveyed booklet 2*a*. The first pressing member 650 and the second pressing member 651 perform the squaring process by pressing the spine 2*a*1 of the booklet 2*a*. These pressing members change the changeover unit by moving it in direction B in FIG. 5 according to the thickness of the booklet 2*a*.

The changeover unit 657 has a reference position detection sensor 659 that detects a reference position for movement in the direction B in FIG. 5. A drive motor SM9 is attached to the changeover base 644 in order to rotate the pressing member and applies a driving force to the support shaft 648*a*. Rotating the support shaft 648*a* rotates the first pressing member 650 and the second pressing member 651. The drive motor SM9 provides a driving portion that causes rotation of the first pressing member 650 and the second pressing member 651 functioning as pressing members.

The squaring unit 640 is also provided with a moving unit 656*b*. The moving unit 656*b* is movable along the slide shafts 642 and 643 supported by a frame (not illustrated) and is supported so as to be movable in the direction of the arrow A as illustrated in FIGS. 4 and 5. The moving unit 656*b* is mounted onto a timing belt 652*b* by a coupling member 653*b*, and driven by a drive motor SM7 through pulleys 654*b* and 655*b*.

A moving portion holds the first pressing member 650 and the second pressing member 651 as pressing members and moves along the spine 2*a*1 of the booklet 2*a*. The moving portion includes the following members. A pulley 654*a* is driven by the drive motor SM6. A timing belt 652*a* is stretched between the pulley 654*a* and a pulley 655*a*. A coupling member 653*a* is fixed to the timing belt 652*a*. A moving unit 656*a* is fixed to the coupling member 653*a*. The moving unit 656*b* includes a moving base 641*b*. A support shaft 648*b* is rotatably attached to the moving base 641*b*. A stopper member 649*b* is fixed to the support shaft 648*b*. The stopper member 649*b* cooperates with the stopper member 649*a* to put the booklet 2*a* into a position for the squaring process by contact with the spine 2*a*1 of the conveyed booklet 2*a*.

Figure 6E:
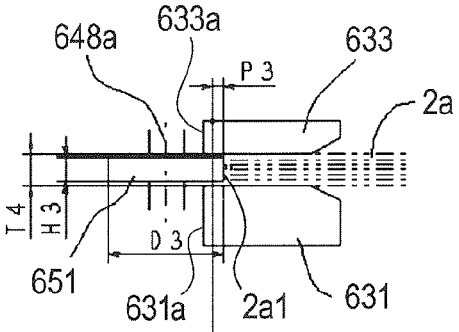
FIG. 6 illustrates configurations of a stopper member and a pressing member.
Figure 6F:
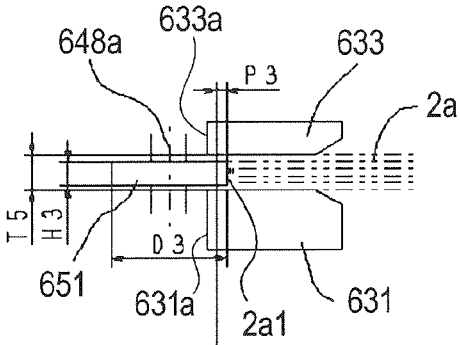
Figure 6C:
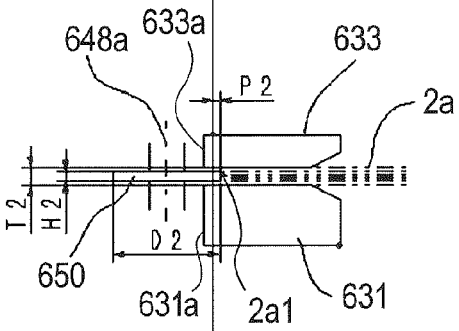
Figure 6D:
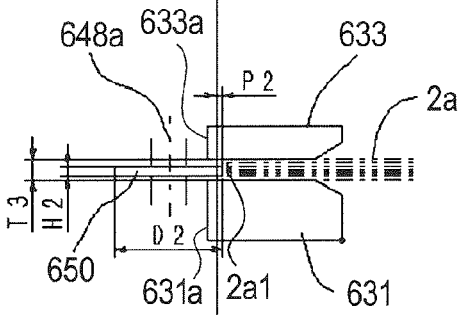
Figure 6A:
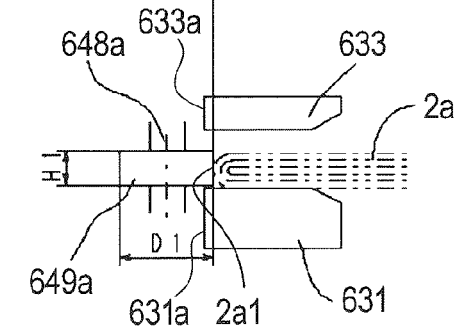
Figure 6B:
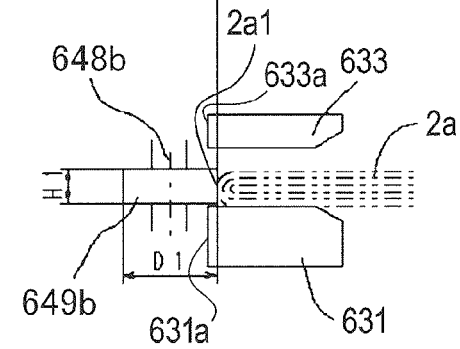

The moving units 656*a* and 656*b* are respectively provided with reference position detection sensors 658*a* and 658*b* that provide reference positions for movement in the direction A in FIG. 5. The stopper members 649*a* and 649*b*, the first pressing member 650, and the second pressing member 651 are each disk-shaped and are sized as illustrated in FIG. 6. As illustrated in FIGS. 6A and 6B, the diameter of each of the stopper members 649*a* and 649*b* is D1. The stopper members 649*a* and 649*b* move in between the upper and lower pressing plates 631 and 633 and put the booklet 2*a* into a position where the booklet 2*a* does not protrude from end portions 631*a* and 633*a* of the upper and lower pressing plates 631 and 633 at the downstream side in the booklet conveying direction. The upper and lower pressing plates 631 and 633 functioning as a holding portion in combination hold the spine 2*a*1 of the folded booklet 2*a* so as not to protrude outward from booklet holding surfaces of the upper and lower pressing plates 631 and 633. The thickness of each of the stopper members 649*a* and 649*b* is H1 and is larger than the thickness of the conveyed booklet 2*a*. This enables even the thick booklet 2*a* to be positioned so that the spine 2*a*1 thereof does not go over the stopper members 649*a* and 649*b*.

The saddle stitch binding portion 800 according to the embodiment produces the booklets 2*a* each of which includes one to 25 sheets 2 folded double. The booklets 2*a* including one to 10 folded sheets 2 are not subject to the squaring process. The booklets 2*a* including 11 to 25 folded sheets 2 are subject to the squaring process. One reason is that the booklet 2*a* including one to 10 folded sheets 2 is thin and hardly ensures a process area (pressing amount) for performing the squaring process on the spine 2*a*1. Another reason is that even the squaring process leaves a swell of the booklet 2*a* unchanged in the thickness direction. The booklets 2*a* formed by folding 11 to 25 sheets 2 in two are subject to the squaring process. In this case, the width of the booklet 2*a* varies. The squaring process is, thus, classified into two thickness ranges of the booklet 2*a*. As illustrated in FIGS. 6C to 6F, the squaring process uses the first pressing member 650 with the thickness of H2 for the booklet 2*a* whose thickness ranges from T2 to T3. The squaring process uses the second pressing member 651 with the thickness of H3 for the booklet 2*a* whose thickness ranges between T4 and T5. Thicknesses T2 through T5 of the booklet 2*a* maintain the relation of T2<T3<T4<T5. The stopper members 649*a* and 649*b* have the thickness of H1. The first pressing member 650 has the thickness of H2. The second pressing member 651 has the thickness of H3. The relation among these thicknesses is H2<H3<H1.

The stopper members 649*a* and 649*b* have the diameter of D1. The first pressing member 650 has the diameter of D2. The second pressing member 651 has the diameter of D3. The relation among these diameters is D1<D2<D3. When the first pressing member 650 is used to square the spine 2*a*1 of the thin booklet 2*a*, it is required that a process area (pressing amount) P2 should be equal to (D2-D1)/2. When the second pressing member 651 is used to square the spine 2*a*1 of the thick booklet 2*a*, and it is required that a process area (pressing amount) P3 should be equal to (D3-D1)/2. The embodiment uses the setting of P2<P3 so that the process area (pressing amount) of the thick booklet 2*a* becomes larger than that of the thin booklet 2*a*. The process area (pressing amount) for the squaring process depends on the diameters D2 and D3 of the first and second pressing members 650 and 651 instead of the positions determined by the stopper members 649*a* and 649*b*.

The stopper members 649*a* and 649*b*, the first pressing member 650, and the second pressing member 651 can reciprocate along the direction A in FIG. 4 in interlock with the moving units 656*a* and 656*b* that slide between the upper and lower pressing plates 631 and 633 in the pressing unit 630. The changeover unit 657 slides when the moving unit 656*a* is not located between the upper and lower pressing plates 631 and 633, namely, when the moving unit 656*a* does not interfere with the upper and lower pressing plates 631 and 633. This enables changeover among the stopper members 649*a* and 649*b*, the first pressing member 650, and the second pressing member 651 located between the upper and lower pressing plates 631 and 633.

When the pressing unit 630 positions the booklet 2*a* conveyed from the inlet conveying portion 620, the stopper members 649*a* and 649*b* are located between the upper and lower pressing plates 631 and 633 within the width of the booklet 2*a* (see FIG. 7A) so as to be symmetrical about the center of the booklet 2*a* in the width direction. The booklet 2*a* can be positioned when its spine 2*a*1 abuts against the stopper members 649*a* and 649*b*.

Figure 7B:
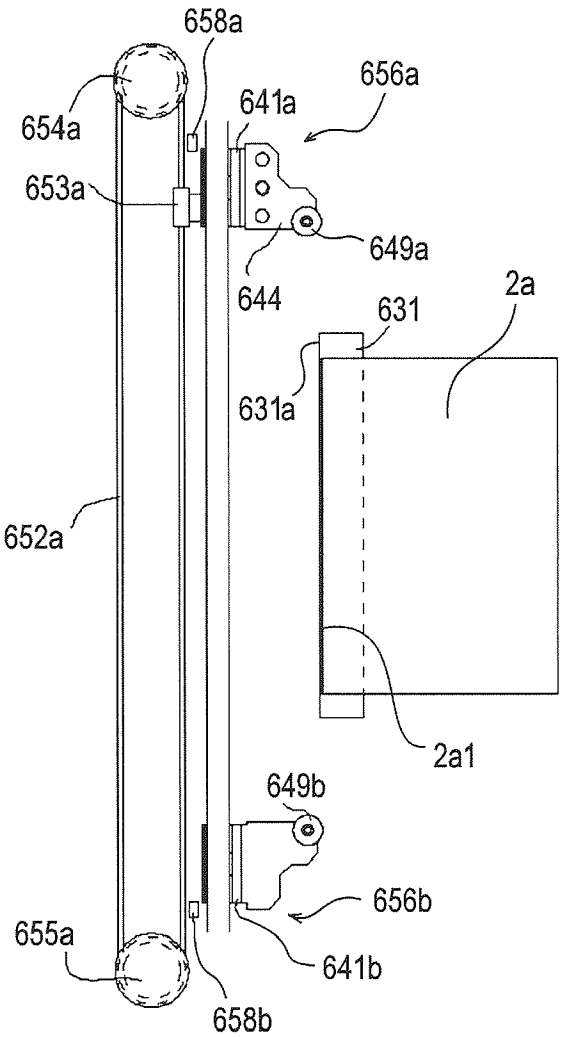
FIG. 7 is an explanatory plan view illustrating operations of the stopper member.

A booklet positioning detection sensor 626 as illustrated in FIG. 3 detects the booklet 2*a* that is conveyed up to the stopper members 649*a* and 649*b*. As described above, the height of each of the stopper members 649*a* and 649*b* is set to be greater than the thickness of the booklet 2*a* in order that the spine 2*a*1 of the thick booklet 2*a* can be positioned through the abutment against the stopper members. When the stopper members 649*a* and 649*b* are located between the upper and lower pressing plates 631 and 633, the upper pressing plate 631 cannot hold the booklet 2*a*. After the booklet 2*a* is positioned as illustrated in FIG. 7B, the stopper members 649*a* and 649*b* are moved outside to both ends of the upper and lower pressing plates 631 and 633. The pressing unit 630 then presses and holds the vicinity of the spine 2*a*1 of the booklet 2*a*. At that time, the spine 2*a*1 of the booklet 2*a* does not protrude from the end portions 631*a* and 633*a* of the upper and lower pressing plates 631 and 633 at the downstream side in the booklet conveying direction. The position of the booklet 2*a* is unchanged because it is nipped between the upper and lower conveying belts 621 and 622 of the inlet conveying portion 620.

Figure 8B:
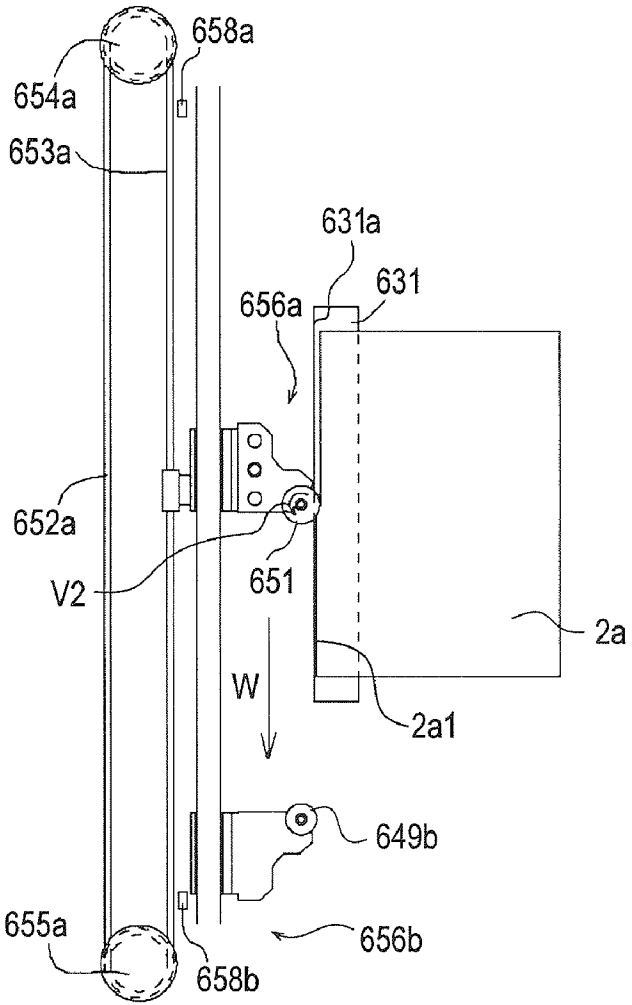
FIG. 8 is an explanatory plan view illustrating operations of the pressing member.
Figure 8A:
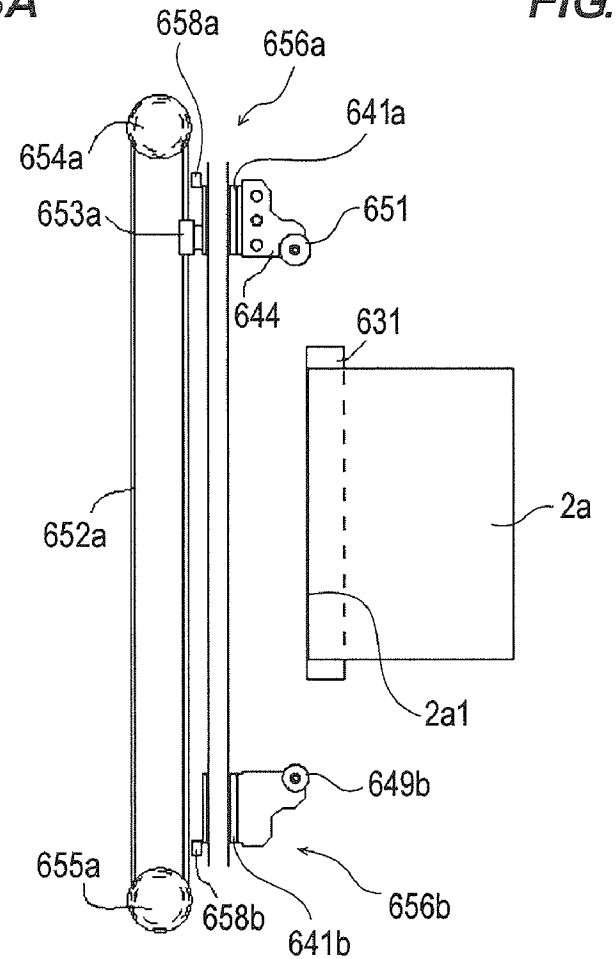
Figure 9B:
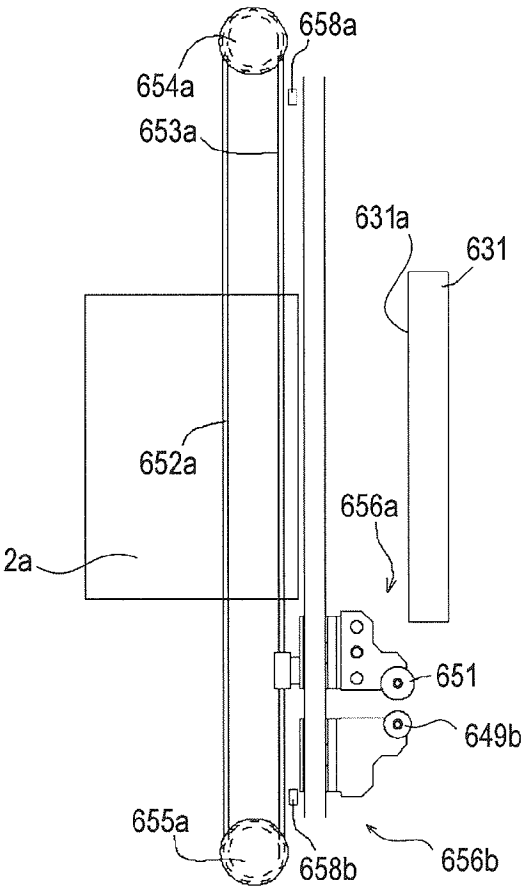
FIG. 9 is an explanatory plan view illustrating a discharge operation for a booklet.
Figure 9A:
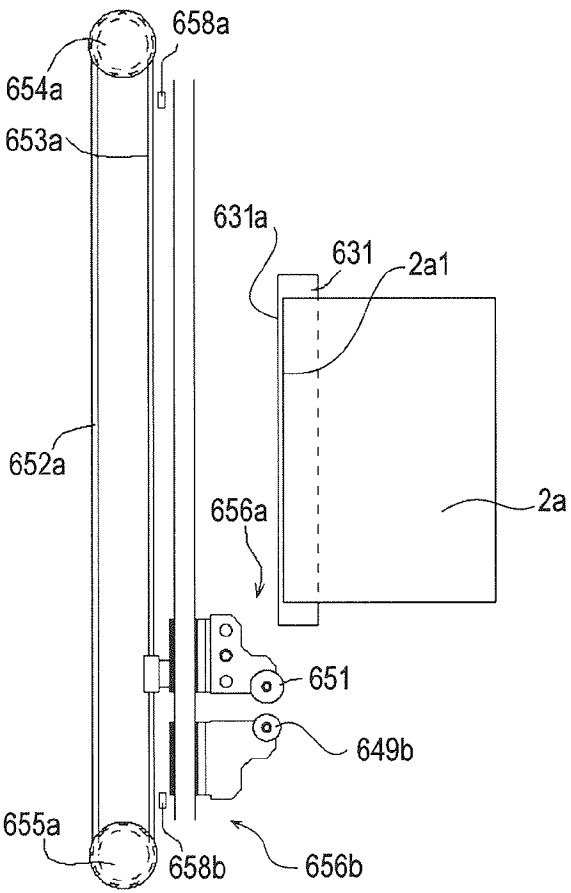
Figure 11:
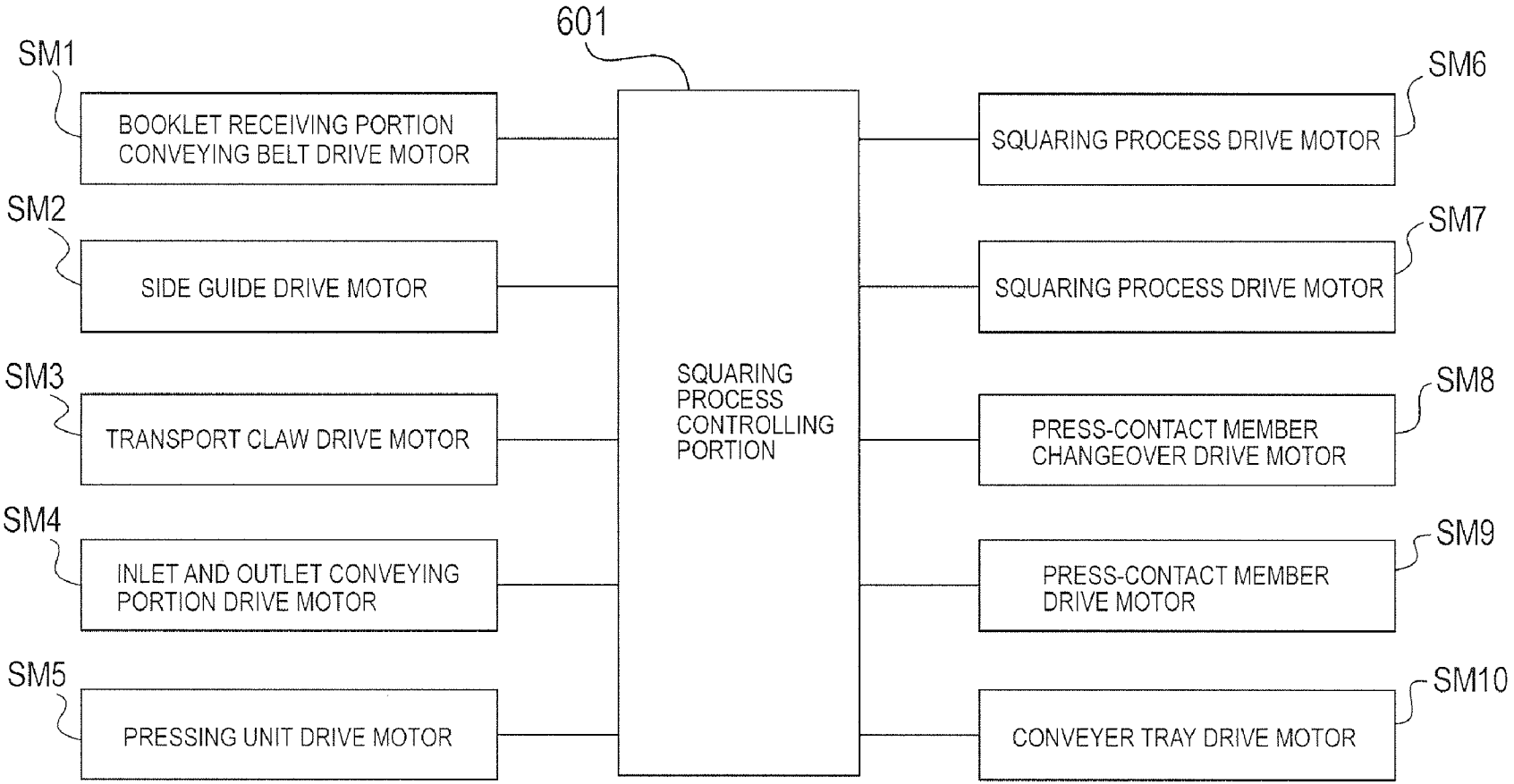
FIG. 11 is a block diagram illustrating a driving system of the sheet post-processing apparatus according to the invention.

As illustrated in FIG. 8A, the changeover unit 657 then changes the stopper member 649*a* to the first pressing member 650 or the second pressing member 651 according to the thickness of the booklet 2*a* detected by a booklet thickness detection sensor 681. FIG. 8A illustrates that the member is changed to the second pressing member 651. As illustrated in FIGS. 8B and 9A, the moving unit 656*a* moves to the opposite side of the booklet 2*a* to press and square the spine 2*a*1 of the booklet 2*a*. The first pressing member 650 or the second pressing member 651 having been changed indicates a circumferential velocity V1 or V2 on the pressing surface at a position where the pressing member presses against the spine 2*a*1 of the booklet 2*a*. The circumferential velocity V1 or V2 of the pressing surface at a position where the pressing surface presses against the booklet spine 2*a*1 is configured so as to be reverse to and greater than the moving velocity W of the moving unit 656*a* as a moving portion. As illustrated in FIG. 8B, the autonomous rotating direction of the first pressing member 650 corresponds to the rotating direction thereof when the first pressing member 650 rotates by contact with the spine 2*a*1 of the booklet 2*a* as the moving unit 656*a* moves. Similarly, as illustrated in FIG. 8B, the autonomous rotating direction of the second pressing member 651 corresponds to the rotating direction thereof when the second pressing member 651 rotates by contact with the spine 2*a*1 of the booklet 2*a* as the moving unit 656*a* moves. Based on the above-mentioned relation of velocity, the autonomous rotation of the first pressing member 650 or the second pressing member 651 applies a force to the pressing surface on the spine 2*a*1 of the booklet 2*a* in upstream of the moving direction. The force prevents the pressing surface from being squeezed downstream in the moving direction due to pressing by the first pressing member 650 or the second pressing member 651. Wrinkle can be prevented from occurring. A squaring process controlling portion 601 as illustrated in FIG. 11 functions as a controlling portion and a changing portion. The squaring process controlling portion 601 functioning as a pressing member can change the circumferential velocity V1 or V2 of the first pressing member 650 or the second pressing member 651 on each pressing surface pressed against the spine 2*a*1 of the booklet 2*a*. The squaring process controlling portion 601 controls driving of the drive motor SM9 as a driving portion that rotates the pressing members. The squaring process controlling portion 601 changes a rotating velocity to change the circumferential velocity V1 or V2.

An occurrence of wrinkle on the spine 2*a*1 of the booklet 2*a* depends on the thickness of the booklet 2*a* or the pressing amount. The squaring process controlling portion 601 selectively changes rotating velocities of the first and second pressing members 650 and 651 corresponding to the selected one of the first and second pressing members 650 and 651. As illustrated in FIG. 6, the circumferential velocity V1 of the first pressing member 650 on the pressing surface differs from the circumferential velocity V2 of the second pressing member 651 on the pressing surface. A large pressing amount causes a large load of squeezing the pressing surface of the booklet 2*a* at a downstream of the moving direction of the moving unit 656*a*. As the load increases, the circumferential velocities V1 and V2 of the first and second pressing members 650 and 651 need to be increased. As illustrated in FIG. 6, the first pressing member 650 having the small thickness (H2) in the thickness direction of the booklet 2*a* indicates the circumferential velocity V1 on the pressing surface. The second pressing member 651 having the large thickness (H3) indicates the circumferential velocity V2 on the pressing surface. The circumferential velocity V2 is configured to be greater than the circumferential velocity V1. As illustrated in FIG. 9B, the squared booklet 2*a* is conveyed at a downstream of the conveying direction in interlock with the upper and lower conveying belts 621, 622, 661, and 662.

The moving unit 656*a* moves at the moving velocity W. The first and second pressing members 650 and 651 generate the circumferential velocities V1 and V2 while the members are pressed against the pressing surface of the spine 2*a*1 of the booklet 2*a*. When the moving velocity W equals the circumferential velocity V1 or V2, the spine of the booklet 2*a* wrinkles. An occurrence of wrinkle on the spine of the booklet 2*a* depends on not only the thickness of the booklet 2*a* and the pressing amount, but also the rigidity of the booklet 2*a* according to the paper type, the basis weight, or an environmental condition during pressing. To solve the problem, the squaring process controlling portion 601 is configured to be capable of adjusting velocities so as to increase the circumferential velocities V1 and V2 of the first and second pressing members 650 and 651 on the pressing surface of the spine 2*a*1 of the booklet 2*a* as the rigidity of the booklet 2*a* increases. The moving unit 656*a* moves along the spine 2*a*1 of the booklet 2*a* by pressing it while the circumferential velocities V1 and V2 are adjusted to increase according to the moving velocity W of the moving unit 656*a*. The booklet 2*a* does not wrinkle after the pressing process.

In FIG. 3, an outlet conveying portion 660 includes a lower conveying belt 661 and an upper conveying belt 662. After the booklet 2*a* is squared and is released from the pressing unit 630, the outlet conveying portion 660 receives the booklet 2*a* and conveys it at a downstream of the booklet conveying direction. The upper conveying belt 662 move about a supporting point 663 in contact with the top face of the booklet 2*a* according to a thickness of the booklet 2*a*. The upper conveying belt 662 is pressed against the lower conveying belt 661 by a spring (not illustrated). The upper and lower conveying belts 661 and 662 are coupled to the inlet conveying portion 620 through the drive-connection, and are driven by the motor SM4.

In FIG. 3, a conveyer tray 670 stacks the booklet 2*a* discharged from the conveying portion 660. A conveyer belt 671 is mounted on the lower surface of the conveyer tray 670 and is driven by a drive motor SM10 to move in the booklet conveying direction. The conveyer belt 671 repeats the movement in a predetermined amount every time the booklet 2*a* is discharged, thereby stacking the booklets 2*a*. A discharge detection sensor 664 detects the discharge of the booklet 2*a* from the outlet conveying portion 660.

Figure 10:
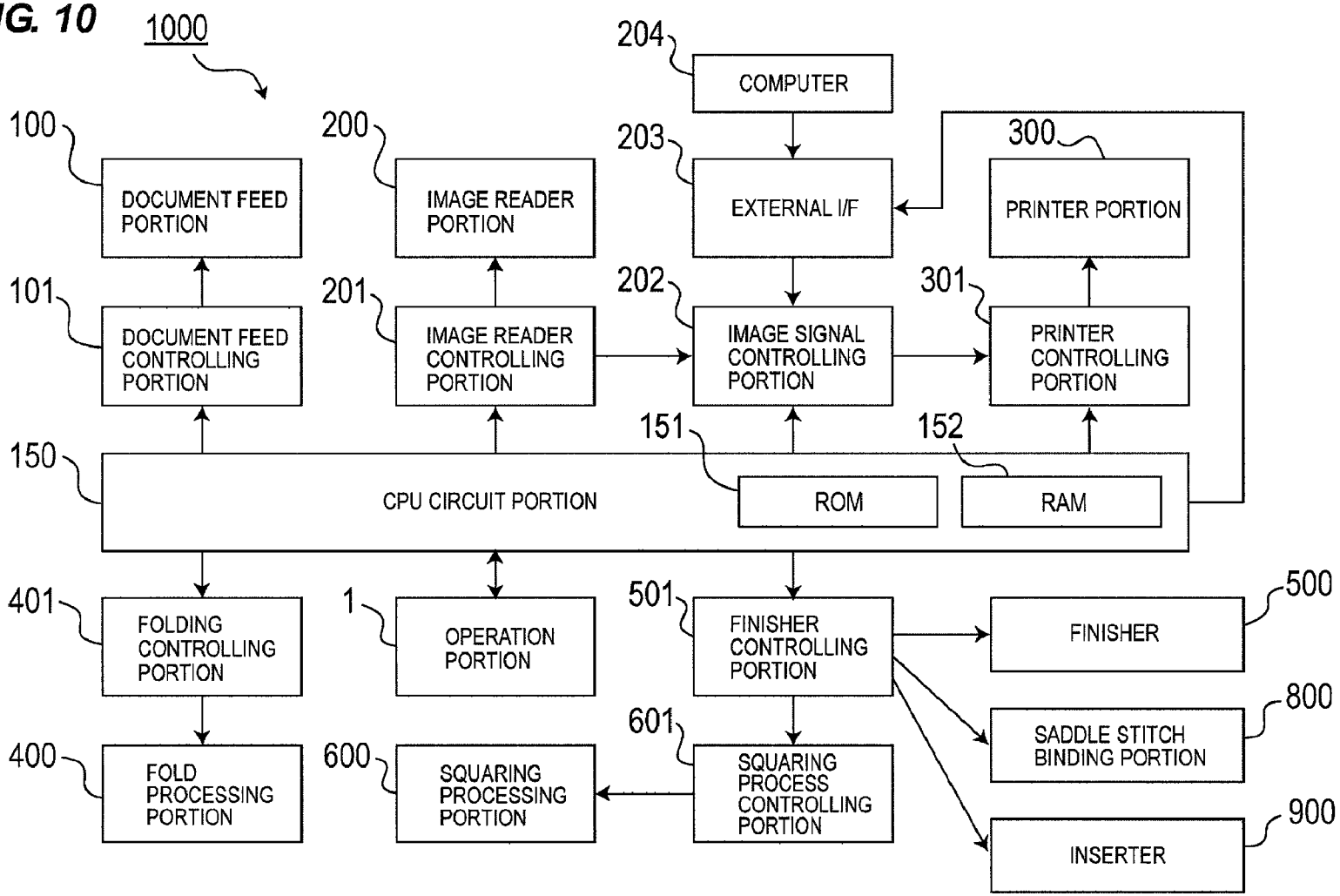
FIG. 10 is a block diagram illustrating a control system of the copier having the sheet post-processing apparatus according to the invention.

FIG. 10 is a block diagram illustrating the copier 1000. A CPU (central processing unit) circuit portion 150 has a CPU (not illustrated). The CPU circuit portion 150 controls the following portions according to a control program stored in ROM (read-only memory) 151 and settings on the operation portion 1. That is, the CPU circuit portion 150 controls a document feed controlling portion 101, an image reader controlling portion 201, an image signal controlling portion 202, a printer controlling portion 301, a folding controlling portion 401, a finisher controlling portion 501, and an external I/F (interface) 203. The document feed controlling portion 101 controls the document feed portion 100. The image reader controlling portion 201 controls the image reader portion 200. The printer controlling portion 301 controls the printer portion 300. The folding controlling portion 401 controls the fold processing portion 400. The finisher controlling portion 501 controls the finisher 500, the saddle stitch binding portion 800, and the inserter 900. The squaring process controlling portion 601 controls the squaring processing portion 600 based on an instruction from the finisher controlling portion 501.

The operation portion 1 has plural keys for setting various functions relating to the image formation, and a display portion for displaying the set state. The operation portion 1 outputs a key signal corresponding to the operation of each key by a user to the CPU circuit portion 150. In addition, the operation portion 1 displays the corresponding information on the display portion based on the signal from the CPU circuit portion 150.

The RAM (random access memory) 152 is used as an area for temporarily retaining the control data or as a working area for computation involved with the control. The external I/F (external interface) 203 is an interface between the copier 1000 and an external computer 204. It expands the print data from the computer 204 into a bit-mapped image, and outputs the resultant as image data to the image signal controlling portion 202. The image reader controlling portion 201 outputs the image of the document 4 read by the image sensor 109 illustrated in FIG. 1 to the image signal controlling portion 202. The printer controlling portion 301 outputs the image data from the image signal controlling portion 202 to the exposure controlling portion 110 illustrated in FIG. 1.

FIG. 11 is a block diagram of the squaring process controlling portion 601. The squaring process controlling portion 601 controls the above-mentioned drive motors SM1 through SM10 as illustrated in FIG. 3. The operation of the squaring process at the squaring processing portion 600 will be described based on the configuration described above. The operations of the respective portions will be described together with the movement of the booklet 2*a*. When a saddle-stitching mode is selected by the operation portion 1, it can be selected whether the saddle-stitching squaring process mode is set or not.

When the saddle-stitching squaring process mode is not selected, the saddle-stitched booklet 2*a* created at the saddle stitch binding portion 800 in FIG. 2 is discharged onto the conveyer tray 670 by the lower conveying belt 611, the transport claw 613, the conveying portion 620, and the outlet conveying portion 660 in FIG. 3. In this case, the pair of side guides 612, the upper pressing plate 633, and the moving units 656*a* and 656*b* in FIG. 5 are retracted at the position where they do not block the booklet conveying path.

Figure 12:
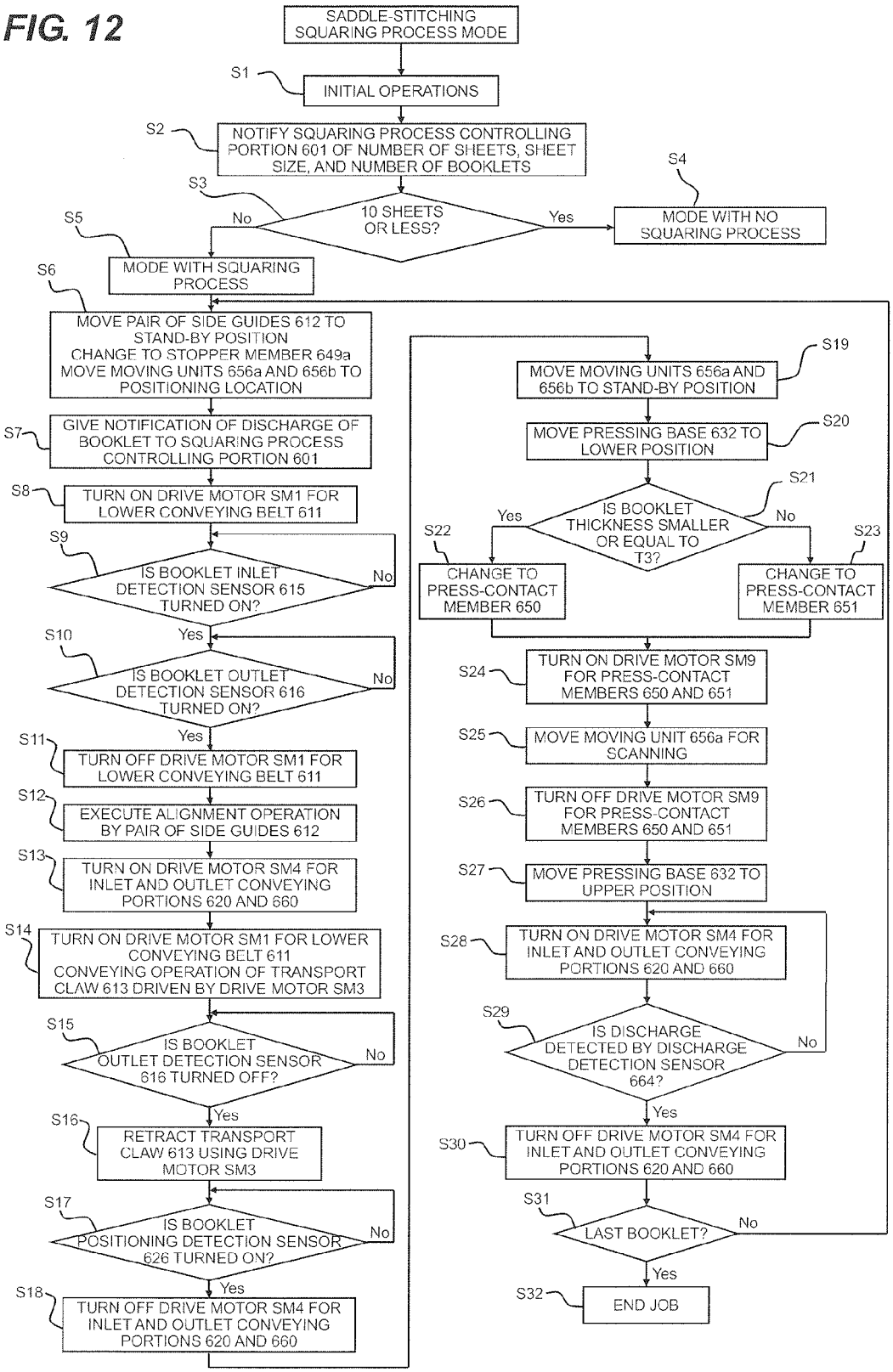
FIG. 12 is a flowchart illustrating operations of the sheet post-processing apparatus according to the invention.

The operation when the saddle-stitching squaring process mode is selected will be described below in detail. FIG. 12 is a flowchart illustrating the flow of the operation when the saddle-stitching squaring process mode is selected. When the saddle-stitching squaring process mode is selected, the squaring processing portion 600 performs an initial operation at step S1 in FIG. 12. That is, in FIG. 3, the pair of side guides 612 is moved to the origin position. The transport claw 613 is moved to the reference position. The pressing base 632 is moved to the upper position. The top dead center detection sensor 639 detects that the pressing base 632 is stationed at the upper position. In FIG. 5, the moving units 656*a* and 656*b* are moved to the reference position. The reference position detection sensors 658*a* and 658*b* detect the resulting state. The changeover unit 657 is moved to the reference position. The reference position detection sensor 659 detects the resulting state. When these initial operations are complete, the squaring processing portion 600 notifies the squaring process controlling portion 601 of the number of sheets 2 of the booklet 2*a*, the sheet size, and the number of booklets 2*a* to be created (step S2). The notification is made before the pair of second fold conveying rollers 812*a* and 812*b* in FIG. 2 discharge the booklet 2*a* to the booklet receiving portion 610 of the squaring processing portion 600. When the notified number of sheets 2 of the booklet 2*a* is smaller than or equal to 10 at Step S3, the squaring process controlling portion 601 selects the "mode with no squaring process" (step S4). When the notified number of sheets 2 of the booklet 2*a* is greater than or equal to 11, the squaring process controlling portion 601 selects the "mode with the squaring process" (step S5).

At Step S6, the pair of side guides 612 moves to the standby position according to the size of the booklet 2*a*. As illustrated in FIG. 3, the pair of side guides 612 is provided at both sides of the booklet conveying path in the booklet receiving portion 610. In addition, the changeover unit 657 illustrated in FIG. 5 changes the member to the stopper member 649*a*. The moving units 656*a* and 656*b* move to the booklet positioning location. The booklet positioning location depends on the size of the booklet 2*a*. The booklet positioning location is set so as to prevent the spine 2*a*1 of the booklet 2*a* from rotating in contact with the stopper members 649*a* and 649*b* and maintain the spine 2*a*1 of the booklet 2*a* parallel to the moving direction A in FIG. 4 of the moving units 656*a* and 656*b*.

The squaring process controlling portion 601 receives a notification to discharge the booklet 2*a* from the saddle stitch binding portion 800 (step S7). The lower conveying belt 611 illustrated in FIG. 3 is rotated by the drive motor SM1 (step S8) to convey the booklet 2*a*. The booklet inlet detection sensor 615 and the booklet outlet detection sensor 616 detect the booklet 2*a*, the bound bundle of sheets 2 (steps S9 and S10). The drive motor SM1 then stops to temporarily stop conveying the booklet 2*a* using the lower conveying belt 611 (step S11).

Thereafter, the pair of side guides 612 is driven by the drive motor SM2 to perform an alignment operation (step S12). The drive motor SM4 then drives the inlet conveying portion 620 and the outlet conveying portion 660 (step S13). The transport claw 613 and the lower conveying belt 611 arranged upstream of the booklet receiving portion 610 restart conveyance of the booklet 2*a* (step S14). The drive motor SM3 drives the transport claw 613. The booklet outlet detection sensor 616 detects that the booklet 2*a* is discharged (step S15). The transport claw 613 then retracts upstream in the booklet conveying direction (step S16).

Figure 13:
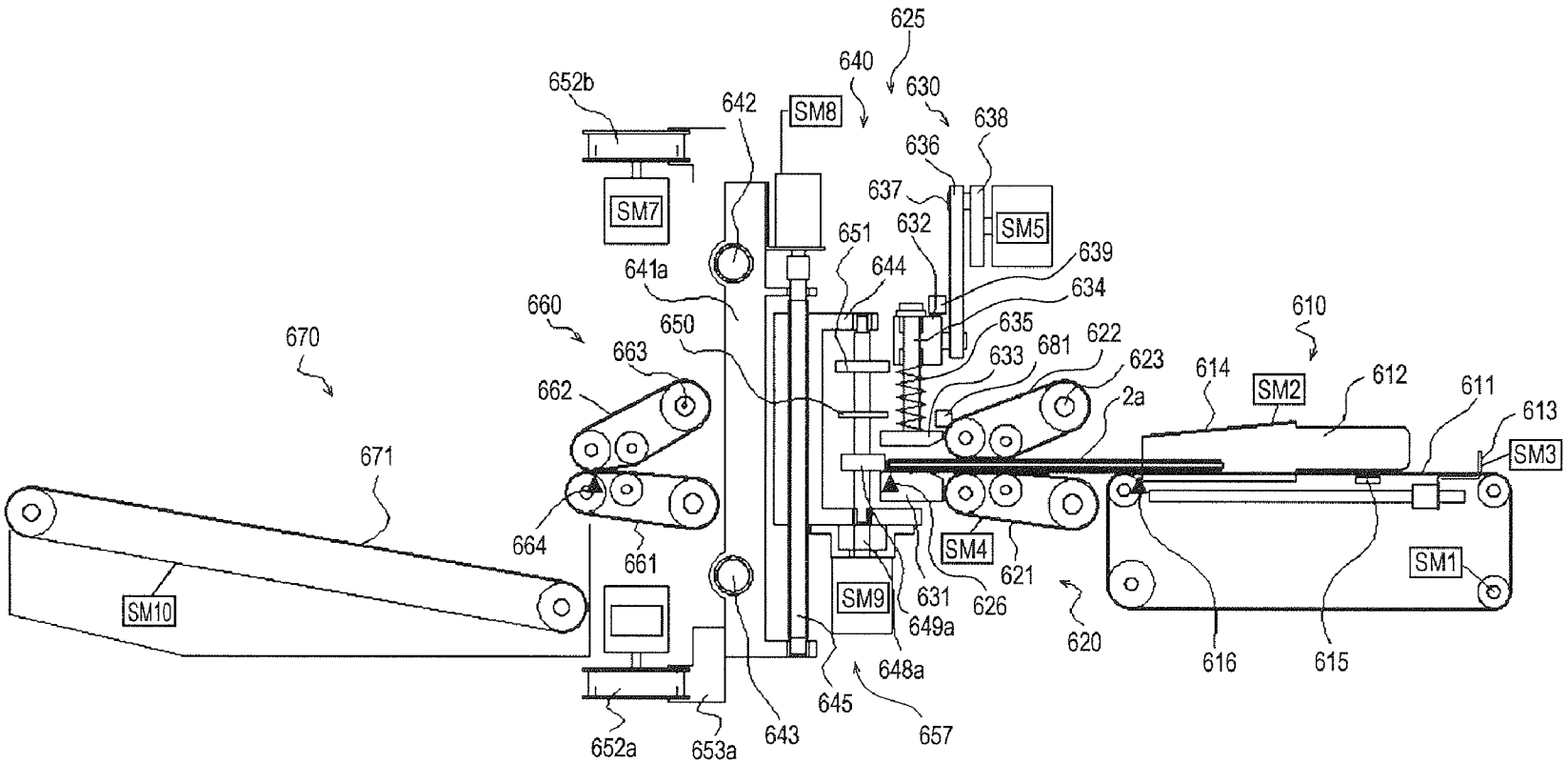
FIG. 13 is an explanatory sectional view illustrating a booklet spine in contact with the stopper member.

The booklet positioning detection sensor 626 detects the booklet 2*a* conveyed by inlet conveying portion 620 (step S17). The inlet conveying portion 620 then stops operating (step S18). As illustrated in FIG. 13, the spine 2*a*1 of the booklet 2*a* comes into contact with the stopper members 649*a* and 649*b*, and is positioned so as not to protrude from the end portions 631*a* and 633*a* at the downstream side in the booklet conveying direction.

The moving units 656*a* and 656*b* illustrated in FIG. 5 then move to a stand-by position (step S19). The stand-by position is located outside the space between the upper and lower pressing plates 631 and 633 and prevents the moving units 656*a* and 656*b* from interfering with the upper and lower pressing plates 631 and 633. The drive motor SM5 moves the pressing base 632 to the lower position (step S20). The upper and lower pressing plates 631 and 633 press and hold the spine 2*a*1 of the booklet 2*a*.

Next, the thickness detection sensor 681 detects the position of the upper pressing plate 633 which presses and holds the booklet 2*a*. The thickness of the booklet 2*a* is measured at step S21. The first pressing member 650 is selected when the thickness of the booklet 2*a* ranges is smaller than or equal to T3 as described with reference to FIG. 6 (step S22).

The second pressing member 651 is selected when the thickness of the booklet 2*a* ranges is larger than T3 (step S23). The drive motor SM9 rotates the first and second pressing members 650 and 651 (step S24). The squaring process controlling portion 601 selectively changes rotating velocities of the first and second pressing members 650 and 651 driven by the drive motor SM9 corresponding to the selected one of the first and second pressing members 650 and 651.

Figure 14:
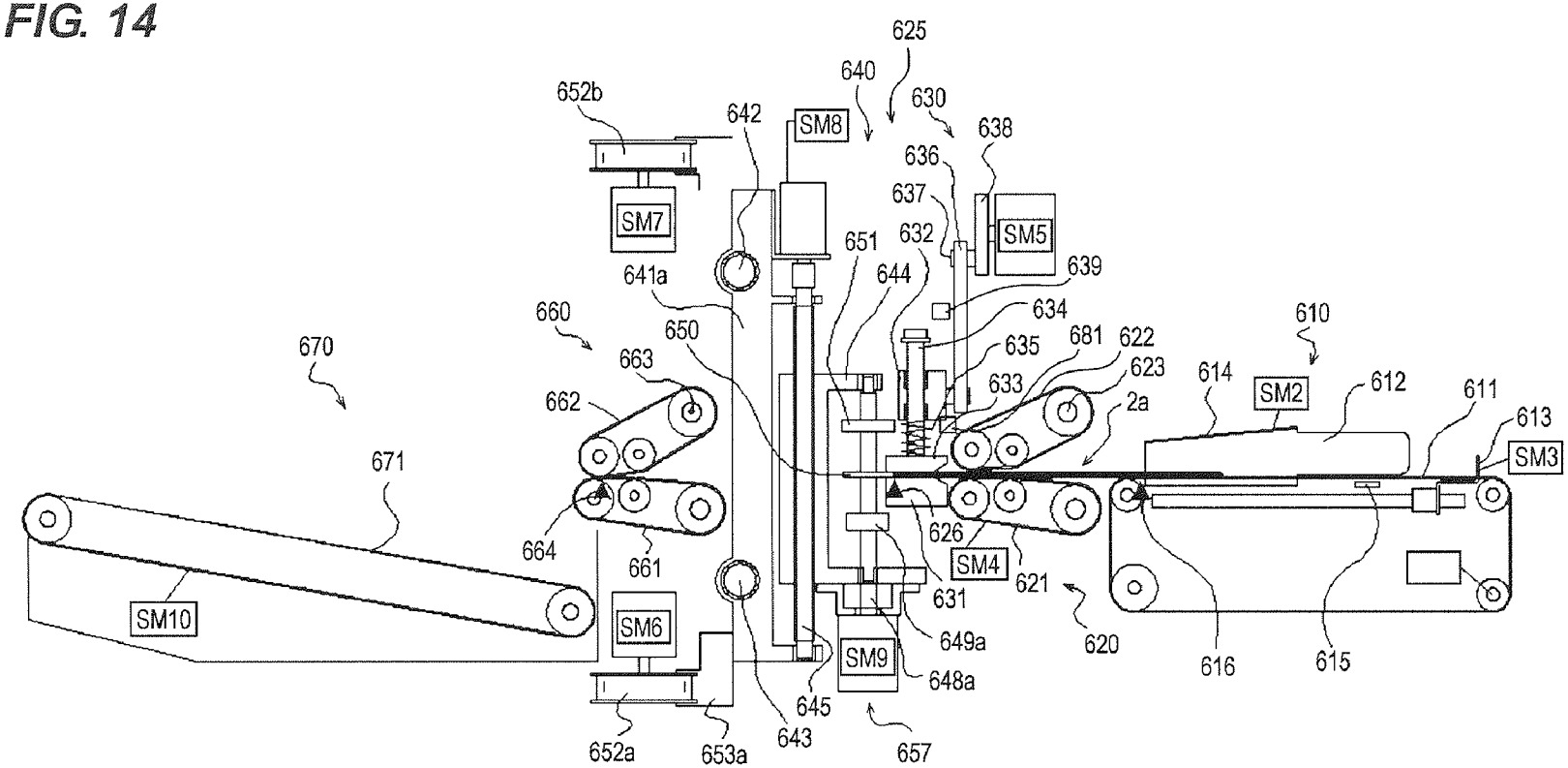
FIG. 14 is an explanatory sectional view illustrating how a first pressing member including a roller presses a booklet spine.
Figure 15:
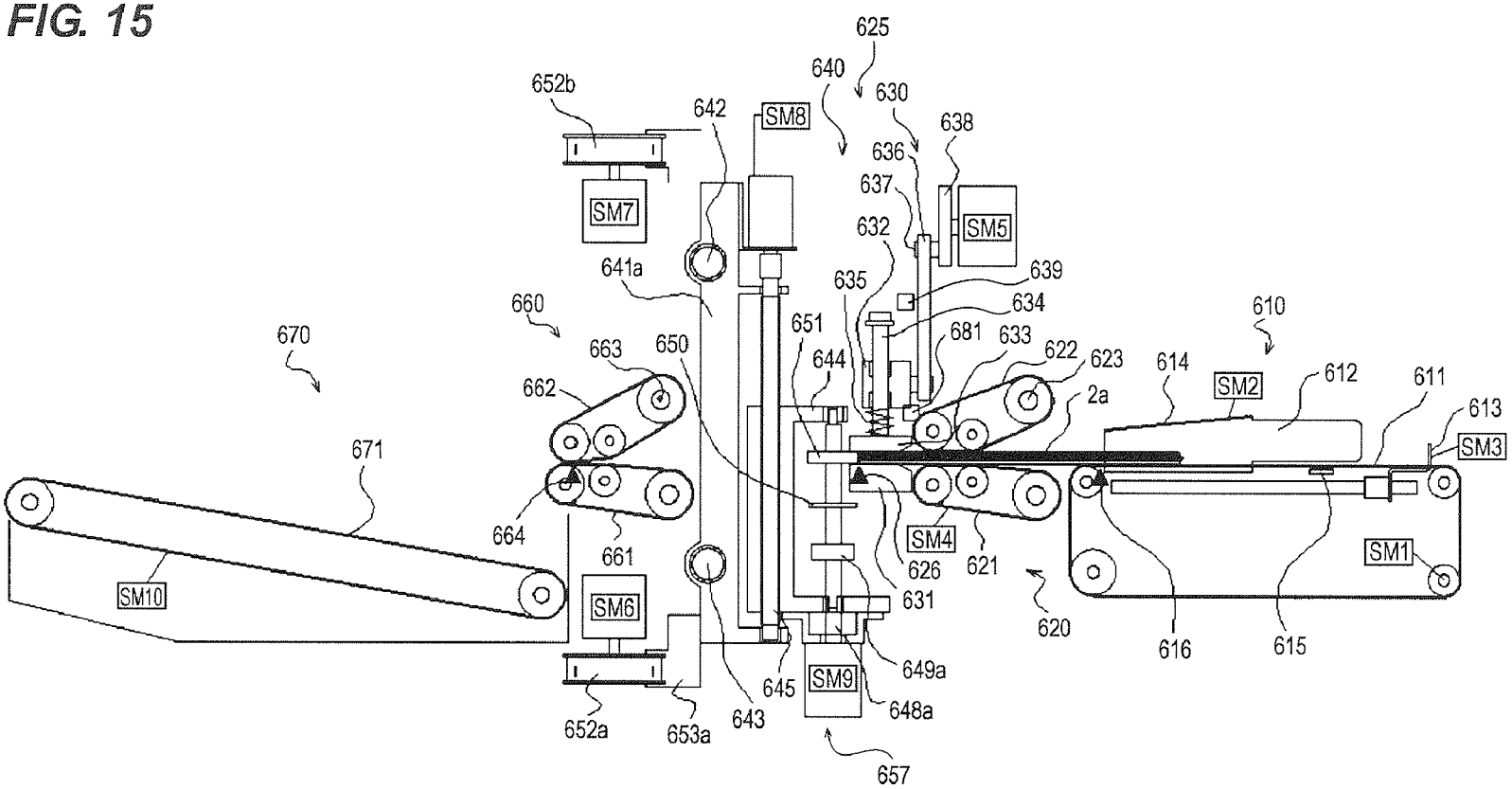
FIG. 15 is an explanatory sectional view illustrating how a second pressing member including a roller presses a booklet spine.

The moving unit 656*a* in FIG. 5 is moved in the moving direction A in FIG. 4 as illustrated in FIG. 8B (step S25) to perform the squaring process on the spine 2*a*1 of the booklet 2*a*. FIG. 14 illustrates the squaring process for the spine 2*a*1 of the booklet 2*a* using the first pressing member 650. FIG. 15 illustrates the squaring process for the spine 2*a*1 of the booklet 2*a* using the second pressing member 651.

As described above, the squaring process controlling portion 601 selectively changes rotating velocities of the first and second pressing members 650 and 651 corresponding to the selected one of the first and second pressing members 650 and 651. Therefore, rotating velocities of the first and second pressing members 650 and 651 are adjustable even though an occurrence of wrinkle depends on the thickness of the booklet 2*a* or the pressing amount. The booklet 2*a* is free from wrinkle. An occurrence of wrinkle on the spine of the booklet 2*a* depends on not only the thickness of the booklet 2*a* and the pressing amount, but also the paper type or the basis weight of the booklet 2*a*, or an environmental condition during pressing. The pressing process is preceded by the configuration of adjusting the circumferential velocities V1 and V2 of the first and second pressing members 650 and 651 on the pressing surface according to these conditions. Consequently, no wrinkle occurs. The booklet 2*a* is neatly bound.

When the movement of the moving unit 656*a* as illustrated in FIG. 5 is complete, the first and second pressing members 650 and 651 driven by the drive motor SM9 stop rotating (step S26). The pressing base 632 illustrated in FIG. 3 moves to the upper position (step S27) to let the upper and lower pressing plates 631 and 633 separate from each other. The drive motor SM4 drives the outlet conveying portion 660 (step S28). The booklet 2*a* is conveyed by the outlet conveying portion 660 and is discharged onto the conveyer tray 670. The discharge detection sensor 664 detects that the booklet 2*a* is discharged (step S29). The outlet conveying portion 660 then stops the drive (step S30). The booklet 2*a* discharged onto the conveyer tray 670 is imbricately stacked one by one. When the booklet 2*a* discharged onto the conveyer tray 670 is not the last one, control returns to step S6. When the last booklet 2*a* is discharged onto the conveyer tray, the job is completed (step S32).

While the above-mentioned embodiment has described the case where the saddle stitch binding portion 800 produces the booklets 2*a* each including one to 25 sheets 2 folded double, the number of sheets 2 included in the booklet 2*a* may be otherwise specified depending on a processing capability of the saddle stitch binding portion 800. While there has been described the case of squaring the booklet 2*a* including 11 or more sheets 2 folded double, the number of sheets 2 may be changed depending on the basis weight or the thickness of the sheet 2. The present invention is not limited thereto. According to the embodiment, whether or not to perform the squaring process depends on whether the booklet includes more than ten sheets. The present invention is not limited thereto. The basis weight and/or the paper type may determine the use of the squaring process as an alternative or in addition to the number of sheets.

According to the embodiment, the squaring process is classified into two stages according to thicknesses of the booklet 2*a*. The squaring process uses the first and second pressing members 650 and 651 with two types of thicknesses H2 and H3 and different diameters D2 and D3. In addition, one type of pressing member may be used. The squaring process may be classified into more stages. It is possible to increase the types of pressing members to be used. The present invention is not limited thereto. The excellent squaring process becomes available using many pressing members enough to be capable of selecting three or more stages.

According to the embodiment, the booklet thickness detection sensor 681 detects the thickness of the booklet 2*a* to determine the squaring process stage. Further, the number of stages may be determined based on conditions for determining the thickness of the booklet 2*a* such as the basis weight or the thickness of the sheet 2 or the number of sheets 2 used for the booklet 2*a*. According to the embodiment, the circumferential velocity V1 of the first pressing member 650 on the pressing surface differs from the circumferential velocity V2 of the second pressing member 651 on the pressing surface in order to prevent a wrinkle on the spine of the booklet 2*a* varying with the thickness of the booklet 2*a* or the pressing amount. However, the other factors may greatly influence an occurrence of wrinkle. The circumferential velocity V1 of the first pressing member 650 on the pressing surface may equal the circumferential velocity V2 of the second pressing member 651 on the pressing surface.

According to the embodiment, the drive motor SM9 rotates the first and second pressing members 650 and 651. Another example uses a rack (not illustrated) parallel to the slide shafts 642 and 643 illustrated in FIG. 5. The rack is engaged with a gear (not illustrated) attached to the moving unit 656*a*. The gear transmits a driving force to the support shaft 648*a* of the first and second pressing members 650 and 651. In this manner, the movement of the moving unit 656*a* driven by the drive motor SM6 may interlock with the rotation of the first and second pressing members 650 and 651.

Second Embodiment

The first embodiment provides the first and second pressing members 650 and 651 using rollers. As illustrated in FIG.

16, the second embodiment uses a belt 665 as a pressing member to move along the spine 2*a*1 of the booklet 2*a* while pressing it.

Figure 16:
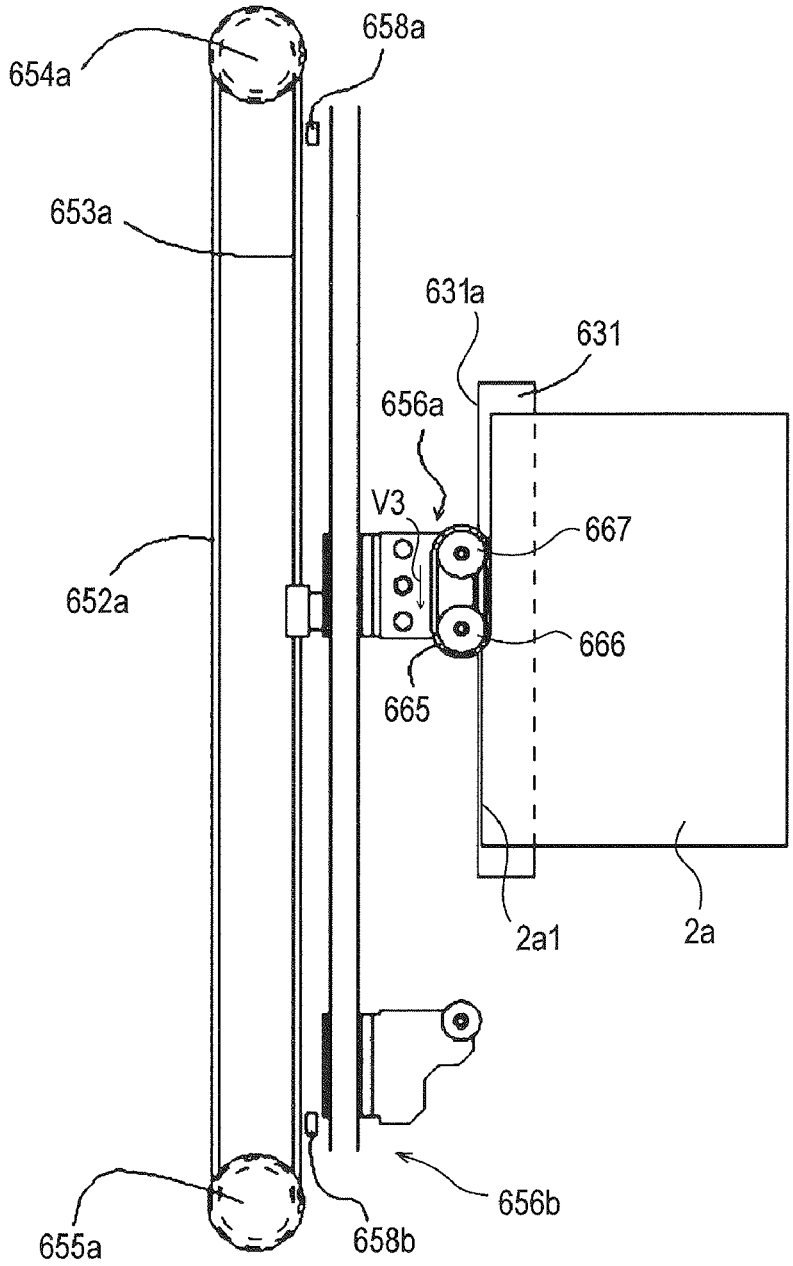
FIG. 16 is an explanatory sectional view illustrating how a pressing member including a belt presses a booklet spine.
Figure 17A:
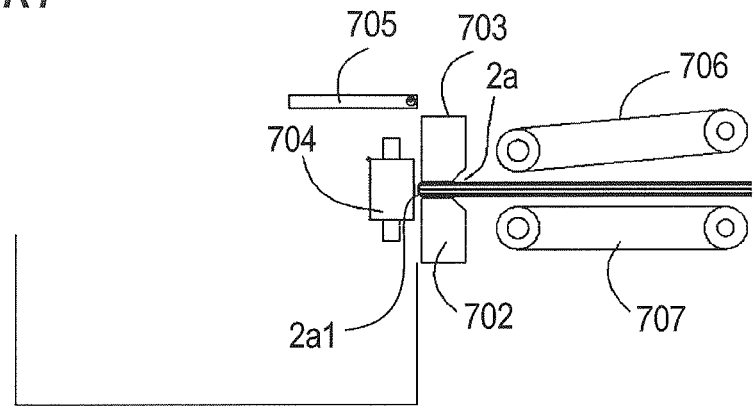
FIG. 17A PRIOR ART
FIG. 17 illustrates an example of the related art.
Figure 17B:
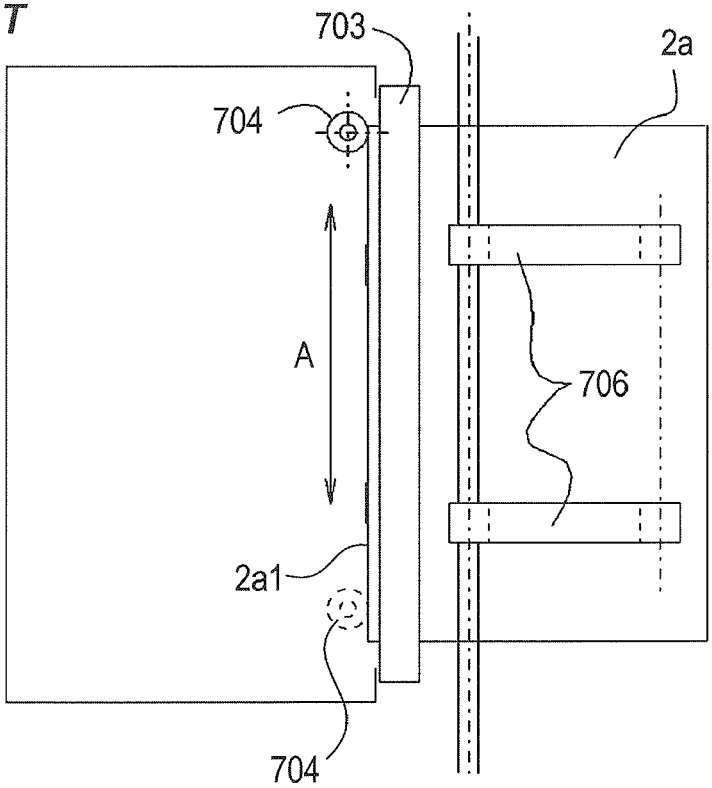
FIG. 17B PRIOR ART
Figure 18:
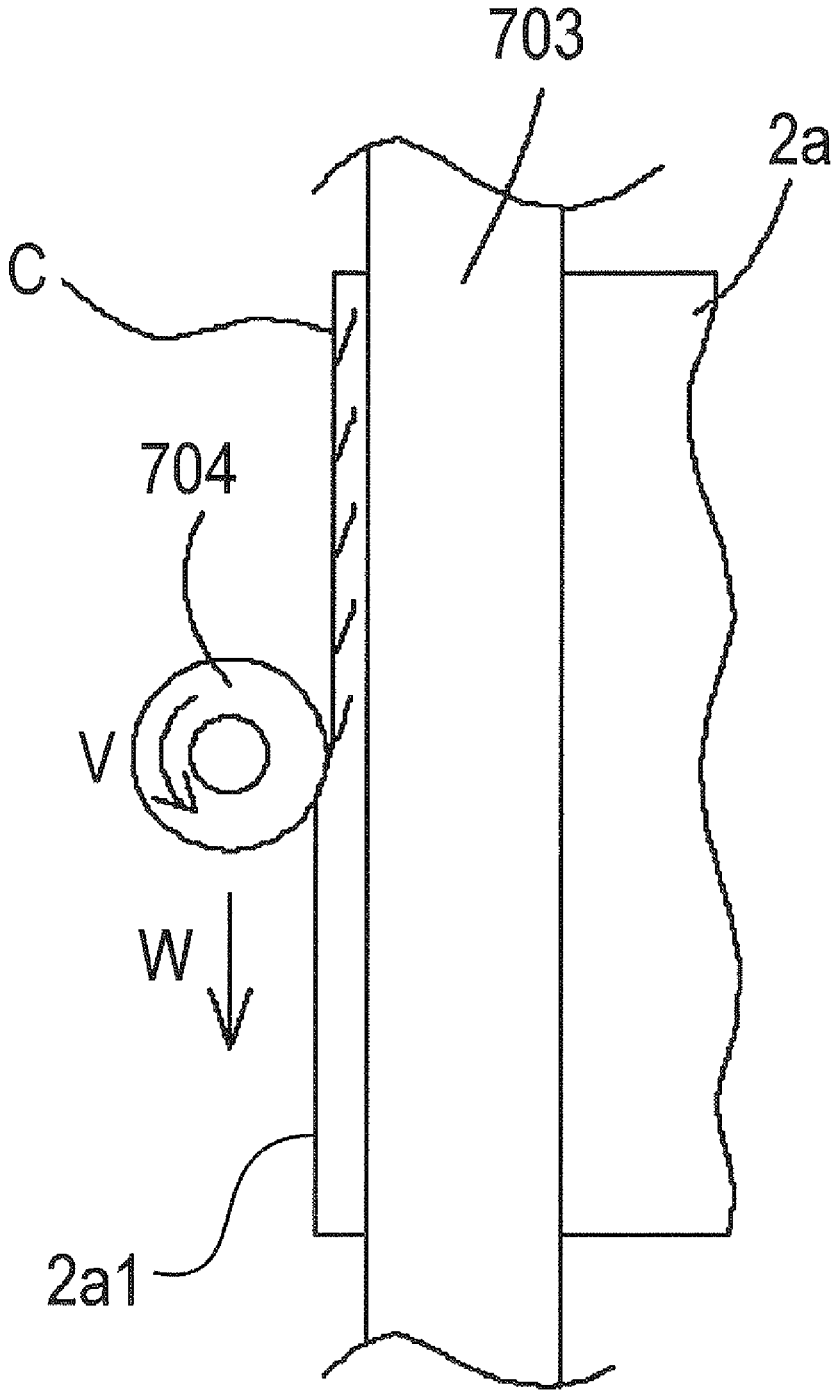
FIG. 18 PRIOR ART
FIG. 18 illustrates a problem of the related art.

The belt 665 illustrated in FIG. 16 is stretched between a drive roller 666 and a pulley 667. The drive roller 666 is driven by the drive motor SM9 as a driving portion that drives the pressing member. The drive motor SM9 as a driving portion drives the belt 665 as a pressing member. The belt 665 moves at a circumferential velocity V3 on the pressing surface where the spine 2*a*1 of the booklet 2*a* is pressed. The squaring process controlling portion 601 functioning as a controlling portion and a changing portion adjusts the circumferential velocity V3 of the pressing surface at a position where the pressing surface presses against the booklet spine 2*a*1 is configured so as to be reverse to and greater than the moving velocity W of the moving unit 656*a* as a moving portion. The second embodiment is configured similarly to the first embodiment in terms of the other components and is capable of providing the same effect.

Figure 7A:
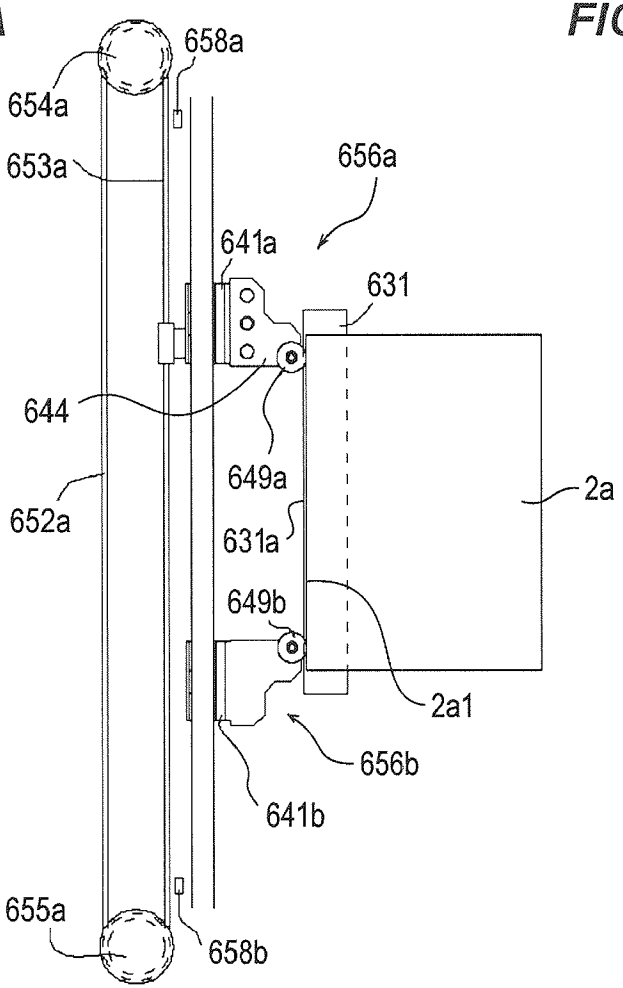

According to the above-mentioned embodiments, as illustrated in FIG. 7A, the stopper members 649*a* and 649*b* move in between the upper and lower pressing plates 631 and 633 illustrated in FIG. 3. The spine 2*a*1 of the booklet 2*a* is positioned so as not to protrude from the end portions 631*a* and 633*a* of the upper and lower pressing plates 631 and 633 at the downstream side in the booklet conveying direction. As described in the example of the related art, the present invention may be applied to a configuration in which the spine 2*a*1 of the booklet 2*a* protrudes from the end portions 631*a* and 633*a* of the upper and lower pressing plates 631 and 633 at the downstream side in the booklet conveying direction. The spine 2*a*1 of the booklet 2*a* is kept protruded from the end portions 631*a* and 633*a* of the upper and lower pressing plates 631 and 633 at the downstream side in the booklet conveying direction. In this state, the upper pressing plate 633 moves downward to vertically press and hold the booklet 2*a* between the upper and lower pressing plates 631 and 633. In this case, the spine 2*a*1 of the booklet 2*a* protrudes from the end portions 631*a* and 633*a* of the upper and lower pressing plates 631 and 633 at the downstream side in the booklet conveying direction. According to the example of the related art, a wrinkle occurs around the spine 2*a*1 of the booklet 2*a* when the circumferential velocity V1 of the first pressing member 650, the circumferential velocity V2 of the second pressing member 651, or the circumferential velocity V3 of the belt 665 is lower than or equal to the moving velocity W of the moving unit 656*a* measured on the pressing surface in contact with the booklet 2*a*. As described in the above-mentioned embodiments, however, the circumferential velocity V1 of the first pressing member 650, the circumferential velocity V2 of the second pressing member 651, or the circumferential velocity V3 of the belt 665 is configured so as to be reverse to and greater than the moving velocity W of the moving unit 656*a* measured on the pressing surface in contact with the booklet 2*a*. This configuration can move the paper near the surface of the spine 2*a*1 of the booklet 2*a* backward in the moving direction of the moving unit 656*a* when the first and second pressing members 650 and 651 or the belt 665 presses and moves along the spine 2*a*1 of the booklet 2*a*. In this manner, no wrinkle occurs around the spine 2*a*1 of the booklet 2*a*. The same effect can be obtained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2010-009839, filed Jan. 20, 2010, which is hereby incorporated by reference herein in its entirety.

What is claimed is:

1. A sheet post-processing apparatus comprising:

a holding portion which holds a folded booklet;

a pressing rotary member configured to have a pressing surface which rotates and presses a spine of the booklet held by the holding portion to deform the spine of the booklet into a square shape;

a driving portion which rotates the pressing rotary member;

a moving portion which holds the pressing rotary member and moves along the booklet spine; and a controlling portion which controls the driving portion so that a circumferential velocity of the pressing rotary member is greater than a moving velocity of the moving portion, and a direction of the circumferential velocity of the pressing rotary member at a position where the pressing suface presses against the booklet spine is opposite to a moving direction of the moving portion.

2. The sheet post-processing apparatus according to claim 1, wherein the pressing rotary member is a roller or a belt.

3. The sheet post-processing apparatus according to claim 1, wherein the controlling portion controls the driving portion so that the circumferential velocity of the pressing rotary member is increased as a booklet thickness increases.

4. The sheet post-processing apparatus according to claim 1, wherein the controlling portion controls the driving portion so that the circumferential velocity of the pressing rotary member is increased as booklet rigidity increases.

5. The sheet post-processing apparatus according to claim 1, wherein the holding portion holds the spine of the folded booklet so that the spine does not protrude from a booklet holding surface of the holding portion.

6. The sheet post-processing apparatus according to claim 1, further comprising a fold processing portion, provided upstream of the holding portion in a booklet conveying direction, which double folds a plurality of stacked sheets.

7. An image forming apparatus comprising:

an image forming portion which forms an image on a sheet; and the sheet post-processing apparatus, wherein the sheet post-processing apparatus includes:

a holding portion which holds a folded booklet;

a pressing rotary member configured to have a pressing surface which rotates and presses a spine of the booklet held by the holding portion to deform the spine of the booklet into a square shape;

a driving portion which rotates the pressing rotary member;

a moving portion which holds the pressing rotary member and moves along the booklet spine; and a controlling portion which controls the driving portion so that a circumferential velocity of the pressing rotary member is greater than a moving velocity of the moving portion, and a direction of the circumferential velocity of the pressing rotary member at a position where the pressing surface presses against the booklet spine is opposite to a moving direction of the moving portion.

8. The image forming apparatus according to claim 7, wherein the pressing rotary member is a roller or a belt.

9. The image forming apparatus according to claim 7, wherein the controlling portion controls the driving portion so that the circumferential velocity of the pressing rotary member is increased as a booklet thickness increases.

10. The image forming apparatus according to claim 7, wherein the controlling portion controls the driving portion so that the circumferential velocity of the pressing rotary member is increased as booklet rigidity increases.

11. The image forming apparatus according to claim 7, wherein the holding portion holds the spine of the folded booklet so that the spine does not protrude from a booklet holding surface of the holding portion.

12. The image forming apparatus according to claim 7, wherein the sheet post-processing apparatus further comprising a fold processing portion, provided upstream of the holding portion in a booklet conveying direction, which double folds a plurality of stacked sheets.

* * * * *